US010442577B2

(12) United States Patent
Karim et al.

(10) Patent No.: US 10,442,577 B2
(45) Date of Patent: Oct. 15, 2019

(54) RECLOSABLE POUCH WITH LEAKPROOF CLOSURE AND METHOD OF MANUFACTURE

(71) Applicant: S.C. Johnson & Son, Inc., Racine, WI (US)

(72) Inventors: Rod M. Karim, San Diego, CA (US); Eliel Borbon, Tijuana Baja California (MX)

(73) Assignee: S.C. Johnson & Son, Inc., Racine, WI (US)

( * ) Notice: Subject to any disclaimer, the term of this patent is extended or adjusted under 35 U.S.C. 154(b) by 156 days.

(21) Appl. No.: 15/253,417

(22) Filed: Aug. 31, 2016

(65) Prior Publication Data

US 2016/0368667 A1 Dec. 22, 2016

Related U.S. Application Data

(63) Continuation-in-part of application No. 13/384,257, filed as application No. PCT/US2011/058091 on Oct. 27, 2011, now Pat. No. 10,065,387.

(Continued)

(51) Int. Cl.
*B65D 33/25* (2006.01)

(52) U.S. Cl.
CPC ..... *B65D 33/2591* (2013.01)

(58) Field of Classification Search
CPC ..... B65D 33/25; B65D 33/2508; B65D 33/2516; B65D 33/2525; B65D 33/2533; B65D 33/2541; B65D 33/255; B65D 33/2558; B65D 33/2566; B65D 33/2575; B65D 33/2583; B65D 33/2591

(Continued)

(56) References Cited

U.S. PATENT DOCUMENTS 4,756,629 A 7/1988 Tilman et al.
4,787,880 A 11/1988 Ausnit (Continued)

FOREIGN PATENT DOCUMENTS

WO 00/76350 A1 12/2000
WO 2012/054897 A2 4/2012

OTHER PUBLICATIONS

Photograph of overall bag, Lock & Lock brand Smartbag Multi Storage Bag, 550 mm×700 mm size, bag acquired 2011 to 2012.

(Continued)

*Primary Examiner* — Jes F Pascua
*Assistant Examiner* — Nina K Attel

(57) ABSTRACT

A reclosable pouch includes a receptacle having a storage chamber and a mouth in communication with the storage chamber. A hermetically sealable closure is attached to the mouth, the closure including a first zipper strip and a second zipper strip. The first and second zipper strips are fused together in first and second zones situated at respective ends of the closure. The first and second zipper strips form a first zipper and a second zipper that terminate in a first zipper termination and a second zipper termination, respectively. A respective pair of elongated projections is arranged on first and second sidewalls of the receptacle. A slider may be mounted to the closure, such that the elongated projections prevent further travel of the slider at opposing ends of the closure.

28 Claims, 29 Drawing Sheets

Related U.S. Application Data

(60) Provisional application No. 61/407,351, filed on Oct. 27, 2010.

(58) Field of Classification Search
USPC ..... 383/61.1, 63–65
See application file for complete search history.

(56) References Cited

U.S. PATENT DOCUMENTS 5,131,121 A 7/1992 Herrington, Jr. et al.
5,238,306 A 8/1993 Heintz et al.
5,246,720 A 9/1993 Buchko
5,335,997 A 8/1994 Kanemitsu et al.
5,442,837 A 8/1995 Morgan
5,448,807 A * 9/1995 Herrington, Jr. .. B65D 33/2591 24/387
5,871,281 A 2/1999 Stolmeier et al.
6,030,122 A 2/2000 Ramsey et al.
6,357,914 B1 3/2002 Kinigakis et al.
6,467,956 B1 10/2002 Tilman et al.
6,508,969 B1 1/2003 Kolovich et al.
6,698,925 B2 3/2004 Bentsen
6,712,510 B2 3/2004 Schneider et al.
6,733,622 B2 5/2004 McMahon et al.
6,743,330 B2 6/2004 Crevier
6,840,675 B2 1/2005 Knight
6,866,420 B2 3/2005 Buchman
6,942,608 B2 9/2005 Linton et al.
6,968,604 B2 11/2005 Crevier
7,056,417 B2 6/2006 Haws et al.
7,185,475 B2 3/2007 Ausnit
7,267,856 B2 9/2007 Patel et al.
7,287,904 B2 10/2007 Withers
7,305,742 B2 12/2007 Anderson
7,306,370 B2 12/2007 Howell et al.
7,347,908 B2 3/2008 Share et al.
7,364,362 B2 4/2008 Schneider et al.
7,416,340 B2 8/2008 Schneider
7,490,989 B2 2/2009 Kobetsky et al.
D588,931 S 3/2009 Kim
7,537,386 B2 5/2009 Linton et al.
7,549,800 B2 6/2009 Ajootian
7,553,082 B2 6/2009 Yoder
7,921,534 B2 * 4/2011 Patel ..... B29C 66/1122 29/408
8,251,585 B2 8/2012 Moulin
8,256,959 B2 9/2012 Hui et al.
8,622,616 B2 1/2014 Petkovsek
8,752,356 B2 6/2014 Bohn et al.
8,882,349 B2 11/2014 Blythe
9,114,914 B2 8/2015 Dais et al.
9,149,980 B2 10/2015 Cham et al.
9,254,620 B2 2/2016 Anzini et al.
9,284,097 B2 3/2016 Heckman
9,296,537 B2 3/2016 Sasaki et al.
9,321,560 B2 4/2016 Dowler et al.
2003/0202718 A1 10/2003 Tomic
2004/0161170 A1 8/2004 Linton et al.
2005/0063616 A1 3/2005 Chang
2005/0135710 A1 6/2005 Melchoir
2006/0029300 A1 2/2006 Yoder
2006/0056743 A1 3/2006 Kobetsky et al.
2006/0285777 A1 12/2006 Howell et al.
2007/0028565 A1 2/2007 Ausnit
2007/0292052 A1 12/2007 Hui et al.
2009/0100650 A1 4/2009 Kim
2011/0299797 A1 12/2011 Petkovsek
2012/0314979 A1 12/2012 Heininga
2013/0108188 A1 5/2013 Karim et al.
2014/0270585 A1 9/2014 Heckman
2015/0367995 A1 12/2015 Turvey et al.
2016/0007693 A1 1/2016 Turvey et al.
2016/0101905 A1 4/2016 Turvey et al.
2016/0194117 A1 7/2016 Goto et al.

OTHER PUBLICATIONS

Photograph of front view of slider on bag, Lock & Lock brand Smartbag Multi Storage Bag, 550 mm×700 mm size, bag acquired 2011 to 2012.
Photograph of side view of slider on bag, Lock & Lock brand Smartbag Multi Storage Bag, 550 mm×700 mm size, bag acquired 2011 to 2012.
Photograph of of slider removed from bag, Lock & Lock brand Smartbag Multi Storage Bag, 550 mm×700 mm size, bag acquired 2011 to 2012.
Photograph of overall bag, Store Smart brand flat (large) bag, 21.5 inches×33.5 inches size, bag acquired 2007 to 2009.
Photograph of brand packaging containing Store Smart brand flat (large) bag, 21.5 inches×33.5 inches size, bag acquired 2007 to 2009.
Photograph of front view of slider on bag, Store Smart brand flat (large) bag, 21.5 inches×33.5 inches size, bag acquired 2007 to 2009.
Photograph of side view of slider on bag, Store Smart brand flat (large) bag, 21.5 inches×33.5 inches size, bag acquired 2007 to 2009.
Photograph of slider removed from bag, Store Smart brand flat (large) bag, 21.5 inches×33.5 inches size, bag acquired 2007 to 2009.
Photograph of overall bag, Ultra PackMax Bag brand compression bag, 27 inches×39 inches size, bag acquired 2007 to 2009.
Photograph of brand packaging containing Ultra PackMax Bag brand compression bag, 27 inches×39 inches size, bag acquired 2007 to 2009.
Photograph of front view of slider on bag, Ultra PackMax Bag brand compression bag, 27 inches×39 inches size, bag acquired 2007 to 2009.
Photograph of slider side view, Ultra PackMax Bag brand compression bag, 27 inches×39 inches size, bag acquired 2007 to 2009.
Photograph of slider removed from bag, Ultra PackMax Bag brand compression bag, 27 inches×39 inches size, bag acquired 2007 to 2009.
Notification of and International Search Report and Written Opinion dated Jun. 11, 2012, in corresponding International Patent Application No. PCT/US2011/058091.

* cited by examiner

RECLOSABLE POUCH WITH LEAKPROOF CLOSURE AND METHOD OF MANUFACTURE

RELATED PATENT APPLICATIONS

This application is a continuation-in-part of copending U.S. patent application Ser. No. 13/384,257, filed Jan. 16, 2012, which is incorporated herein by reference in its entirety, and which is a U.S. national stage application of PCT International Application No. PCT/US2011/058091, filed Oct. 27, 2011, published as International Publication No. WO 2012/058428 A1, and which claims priority to U.S. Provisional Application No. 61/407,351, filed on Oct. 27, 2010.

BACKGROUND

This invention generally relates to reclosable flexible bags whose interior volume is hermetically sealed when the bag is closed. In particular, the invention relates to, but is not limited to, evacuable reclosable storage bags having a zipper that is closed (but not opened) by operation of a slider or clip mounted on the zipper.

Collapsible, evacuable storage containers typically include a flexible, airtight bag, an opening through which a compressible article is inserted inside the bag, a zipper for closing the opening and hermetically sealing the bag, a U-shaped slider for closing the zipper, and one or more one-way valves or vents through which excess air is evacuated from the bag. A user places an article into the bag through the opening, seals the opening, and then removes air from the bag through the one-way valve or valves. As air is removed, the compressible article contained therein may be significantly compressed so that it is easier to transport and requires substantially less storage space.

Collapsible, evacuable storage containers are beneficial for reasons in addition to those associated with compression of the stored article. For example, removal of the air from the storage container inhibits the growth of destructive organisms, such as moths, silverfish, and bacteria, which require oxygen to survive and propagate. Moreover, such containers, being impervious to moisture, inhibit the growth of mildew.

Not only large, compressible items such as clothing may be stored in a collapsible, evacuable storage container. For example, it may be desirable to store bulk items made of small particles, such as powders or granulated resins, in an evacuated container. One situation that commonly occurs is that a particular bulk item is shipped in a large, rigid container such as a drum. Bulk items may be moisture sensitive and are sealed against moisture during shipment. But many times a user does not need the entire contents of the large container, and so once exposed to the air, the remaining bulk contents quickly become unusable and are thus wasted.

Many commercially available evacuable storage bags are provided with an inverted U-shaped slider or clip mounted to the plastic zipper. This slider is capable of closing an open zipper, i.e., by camming the opposing zipper strips into engagement during slider travel in either direction, but cannot be used to open a closed zipper. The slider does not have means for opening the zipper because typically such means would leave a gap in the zipper, thereby preventing formation of a hermetic seal.

In known reclosable bags, the zipper comprises a pair of mutually interlockable zipper strips, each zipper strip having one or more generally constant profiles extending across the mouth of the bag. For example, it is known to provide a reclosable bag having dual zippers that extend in parallel across the mouth of the bag. The ends of the zipper strips are joined together at the sides of the bag. For example, it is known to fuse the ends of the zipper strips together, at the same time that the bag side seals are formed, by the application of heat and pressure. This "thermal crushing" of the plastic zipper creates a transition between "as is" zipper and crushed zipper that is susceptible to the presence of leaks through which air can enter an evacuated bag. In addition, such crushing leaves the surface material flat at either end where the zipper ends are joined to each other and to the webs of film that form the front and rear walls of the bag.

There is a continuing need for improvements in the construction of flexible storage containers that need to be hermetically sealed. In particular, there is a need for an improved evacuable storage container wherein leakage is eliminated in the areas where the bag side seals overlap the joined ends of the zipper strips. There is also a need for a leakproof construction that provides means for stopping a U-shaped slider at either end of the bag mouth as it travels along the closure.

SUMMARY

The improved sealing method disclosed herein allows the ends of the closure to be joined while at the same time forming a dome-shaped projection at respective joined ends of the closure. In one embodiment, the closure comprises a double zipper. The purpose of the dome structure is to prevent the slider or clip from coming off the bag when the consumer closes the double zippers. The ability of the clip to stay on the closure is a desirable benefit to the consumer. A bag without a zipper clip is difficult to close.

In addition, known methods leave the zipper profile(s) (i.e., the interlockable elements of the closure) to be randomly terminated. In accordance with the teaching herein, the ends of the zipper profiles are terminated using dies that allow the formation of uniform and consistent terminations in the zone where the ends of the zipper strips are joined.

The various shaped slider end stops and the zipper profile terminations can be produced by heat sealing, either ultrasonically or through resistance heating, of the closure material. After the closure material has been softened by ultrasonic energy or resistance heating, dies are used to form the dome structures and terminations of the zipper profiles. In order to cause the soft material to harden in a short period of time, a cooling process is used to shorten the time required for the material to harden. Alternatively, the various shaped slider end stops and the zipper profile terminations can be produced by a cold forming process in which portions of a closure material that have been heated in previous processes are cold formed to create the end stop structures and/or zipper terminations by dimple dies.

According to one aspect, our invention provides a reclosable pouch comprising a receptacle having a storage chamber and a mouth in communication with the storage chamber. The receptacle comprises a first sidewall and a second sidewall connected to the first sidewall so as to form the storage chamber. A hermetically sealable closure is attached to the mouth, with the closure comprising a first zipper strip and a second zipper strip. The first and second zipper strips are fused together in first and second zones situated at respective ends of the closure, with a space between the first and second zones. A portion of the first zipper strip in the space between the first and second zones comprises first and second closure elements projecting from the first zipper strip, and a portion of the second zipper strip in the space between the first and second zones comprises third and fourth closure elements projecting from the second zipper strip. The first and third closure elements form a first zipper that terminates in a first zipper termination at each of the first and second zones, and the second and fourth closure elements form a second zipper that terminates in a second zipper termination at each of the first and second zones. The first through fourth closure elements span the space between the first and second zones. A respective pair of elongated projections is arranged on the first and second sidewalls of the receptacle. Each projection of the respective pair of elongated projections has (i) a length that is equal to or greater than the distance between centerlines of the first and second zippers and (ii) at least one angle with respect to the respective sidewall of the receptacle of at least about 51 degrees.

According to another aspect, our invention provides a reclosable pouch comprising a receptacle having a storage chamber and a mouth in communication with the storage chamber. The receptacle comprises a first sidewall and a second sidewall connected to the first sidewall so as to form the storage chamber. A hermetically sealable closure is attached to the mouth, with the closure comprising a first zipper strip and a second zipper strip. The first and second zipper strips are fused together in first and second zones situated at respective ends of the closure, with a space between the first and second zones. A portion of the first zipper strip in the space between the first and second zones comprises first and second closure elements projecting from the first zipper strip, and a portion of the second zipper strip in the space between the first and second zones comprises third and fourth closure elements projecting from the second zipper strip. The first and third closure elements form a first zipper that terminates in a first zipper termination at each of the first and second zones, and the second and fourth closure elements form a second zipper that terminates in a second zipper termination at each of the first and second zones. The first through fourth closure elements span the space between the first and second zones. A respective pair of elongated projections is arranged on the first and second sidewalls of the receptacle. Each of the elongated projections extend from one of (i) a point above the first zipper to a point between the first and second zippers, (ii) a point below the second zipper to a point between the first and second zippers, and (iii) a point above the first zipper to a point below the second zipper.

According to yet another aspect, our invention provides a reclosable pouch comprising a receptacle having a storage chamber and a mouth in communication with the storage chamber. The receptacle comprises a first sidewall and a second sidewall connected to the first sidewall so as to form the storage chamber. A hermetically sealable closure is attached to the mouth, with the closure comprising a first zipper strip and a second zipper strip. The first and second zipper strips are fused together in first and second zones situated at respective ends of the closure, with a space between the first and second zones. A portion of the first zipper strip in the space between the first and second zones comprises first and second closure elements projecting from the first zipper strip, and a portion of the second zipper strip in the space between the first and second zones comprises third and fourth closure elements projecting from the second zipper strip. The first and third closure elements form a first zipper that terminates in a first zipper termination at each of the first and second zones, and the second and fourth closure elements form a second zipper that terminates in a second zipper termination at each of the first and second zones. The first through fourth closure elements span the space between the first and second zones. A slider is mounted to the closure, and a respective pair of elongated projections is arranged on the first and second sidewalls of the receptacle. Each of the elongated projections prevents further travel of the slider at opposing ends of the closure upon contact with the slider. An average force of greater than about 9.0 lbf is required to remove the slider from the pouch over at least one of the elongated projections.

Other aspects and advantages of the present invention will become apparent upon consideration of the following detailed description.

BRIEF DESCRIPTION OF THE DRAWINGS

Reference will now be made to the drawings in which similar elements in different drawings bear the same reference numerals.

DETAILED DESCRIPTION

Figure 1:
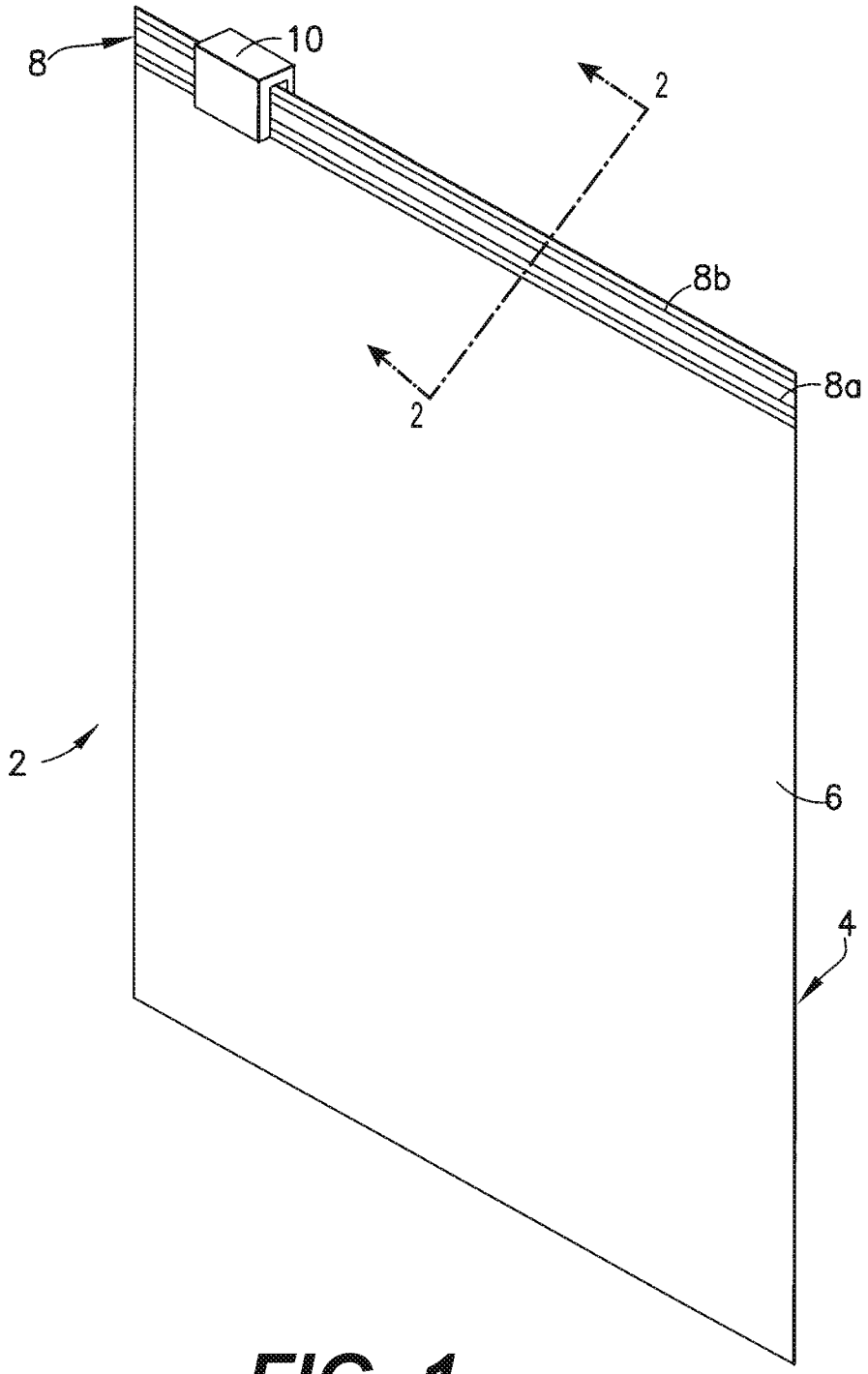
FIG. 1 is a diagram showing an isometric view of a reclosable pouch.

FIG. 1 shows a collapsible reclosable storage pouch 2 in accordance with one embodiment. The storage pouch 2 comprises a receptacle 4 consisting of a front wall or panel 6 and a rear wall or panel (not shown in FIG. 1, but see item 12 in FIG. 2), which are sealed together in left and right marginal regions along their side edges. Although not shown in FIG. 1, the bottom of the receptacle 4 has a one-way vent, comprising multiple collapsible channels, that extends from one side seal to the other. The front and rear walls are heat sealed together at multiple locations across the pouch bottom to form multiple collapsible channels that allow escape of air from the interior volume when the contents (not shown) from the receptacle are compressed, but prevent the entry of air into the receptacle when the external pressure is released. The walls of the receptacle may be formed of various types of gas-impermeable thermoplastic web material. The preferred gas-impermeable thermoplastics are nylon, polyester, polyvinyl dichloride, and ethylene vinyl alcohol.

The upper marginal portions of the front and rear walls of the pouch 2 form a mouth in which a plastic closure 8 comprising double zippers 8*a* and 8*b* is installed. To maintain a vacuum inside the storage pouch, the closure 8 when closed must provide a hermetic seal at the mouth of the pouch. The closure is made from a plastic material that is less flexible than the plastic material of the pouch walls. The front and rear wall panels of the receptacle 4 are respectively sealed to the closure by lengthwise conduction heat sealing in conventional manner. Alternatively, the closure 8 can be attached to the wall panels by adhesive or bonding strips.

Still referring to FIG. 1, the zippers 8*a* and 8*b* can be closed using a device 10 commonly referred to as a "slider" or "clip," that straddles the closure 8. During use, one or more discrete compressible articles (not shown) may be placed inside the receptacle 4 while the closure 8 is open, i.e., while the interlockable closure elements of zippers 8*a* and 8*b* are disengaged from each other. After the article to be stored has been placed inside the receptacle, the closure 8 is closed by moving the slider 10 in either direction, from one end of the closure to the other, thereby pressing the closure elements of zippers 8*a* and 8*b* into interlocking relationship. Although the interlockable closure elements may have many different designs, the design must be one that ensures formation of an airtight seal at the receptacle mouth.

The pouch described above is designed for storing compressible articles. When the contents of the pouch with closed mouth are compressed by a user pushing down on the pouch, air inside the pouch is forced through the one-way vent at the pouch bottom, thereby forcing some or all of its collapsed channels open. When those channels have been fully opened, continued pushing down on the pouch causes the air that was forced into those channels to escape via respective air outlets (not shown). This procedure can be continued until the desired amount of air has been removed from the pouch 2. When the pressure exerted on the pouch by the user is removed, the opened channels collapse, thereby blocking the re-entry of ambient air into the pouch via those channels. Alternatively, air inside the pouch can be evacuated or forced through the one-way vent at the pouch bottom by drawing a vacuum through the vent. As above, a vacuum can be applied to the one-way vent until the desired amount of air has been removed from the pouch 2.

Figure 2:
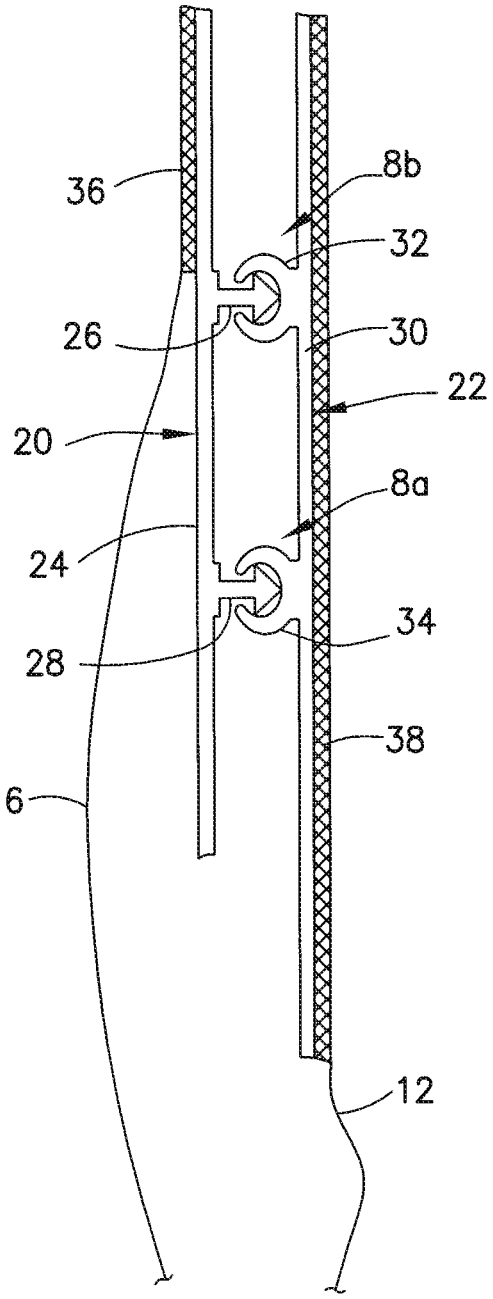
FIG. 2 is a diagram showing a cross-sectional view taken along line 2-2 of FIG. 1 of a double zipper attached to the walls of the reclosable pouch.

The present invention is not directed to any particular zipper construction. A suitable exemplary zipper construction is shown in FIG. 2. The closure 8 comprises a pair of extruded zipper strips 20 and 22 that are joined to each other in respective zipper crush areas at opposing ends of the closure. Zipper strip 20 comprises a web or flange 24 and a pair of mutually parallel male closure elements 26 and 28; zipper strip 22 comprises a web or flange 30 and a pair of mutually parallel female closure elements 32 and 34 that receive and grasp male closure elements 26 and 28, respectively. The closure elements 26 and 32 are designed to form an airtight zipper 8*a* when male closure element 26 is seated in female closure element 32 along the entire length of the pouch mouth. Likewise the closure elements 28 and 34 are designed to form an airtight zipper 8*b* when male closure element 28 is seated in female closure element 34 along the entire length of the pouch mouth.

As previously noted, the zipper flanges 24 and 30 are more rigid than the adjoining pouch walls 6 and 12. In accordance with one embodiment, only an uppermost portion of zipper flange 24 is attached to an uppermost marginal portion of pouch wall 6 by means of a heat seal 36, which heat seal does not extend to the elevation of male closure element 26. Thus, as seen in FIG. 2, a major portion of zipper flange 24 is not attached to the pouch. Meanwhile, the entirety of the zipper flange 30 is attached to an uppermost marginal portion of pouch wall 12 by means of a heat seal 38. This configuration prevents the zippers 8*a* and 8*b* from being forced open when the user compresses the pouch contents because a pressure is exerted on the unattached portion of zipper flange 24 that urges the zippers 8*a* and 8*b* to stay engaged rather than forcing the zipper flanges apart, as would be the case if the entireties of both flanges were attached to the pouch walls.

FIG. 2 shows the zipper 8*a* and 8*b* in respective closed states. The uppermost marginal portions of the pouch mouth (including the uppermost marginal portions of the zipper flanges 24 and 30) can be gripped by the user and pulled apart to open the closed zippers. The opened zipper can be reclosed by pressing the closure elements together along the entire length of the pouch mouth, using a slider. Typically, such a slider takes the form of a U-shaped clip that fits over the zipper with clearance for the upper flanges, while the legs of the clip cam the closure elements of the incoming zipper section into engagement when the slider is moved along the zippers in either direction. In each pouch, opposing ends of the zipper strips 24 and 30 are typically fused together in the regions of the pouch side seals.

In a known method for making hermetically sealed zipper joints, the closure elements are crushed in respective areas at opposite ends of the pouch mouth. This known method produces flattened material in crush zones at opposite corners of the pouch. However, it would be desirable to provide structure in the crush zones for preventing the slider from coming off a pouch corner when the consumer closes the double zipper. A pouch without a slider is difficult to close.

In accordance with one embodiment, a method of manufacture is provided whereby a slider end stop 14 is formed in the upper corner 50 of the pouch to prevent a slider 10 from coming off. In addition, the crushed zipper material adjacent to the uncrushed ends of the closure elements is formed into respective zipper terminations 16 and 18 that form leakproof seals at the ends of the closure elements.

Figure 3:
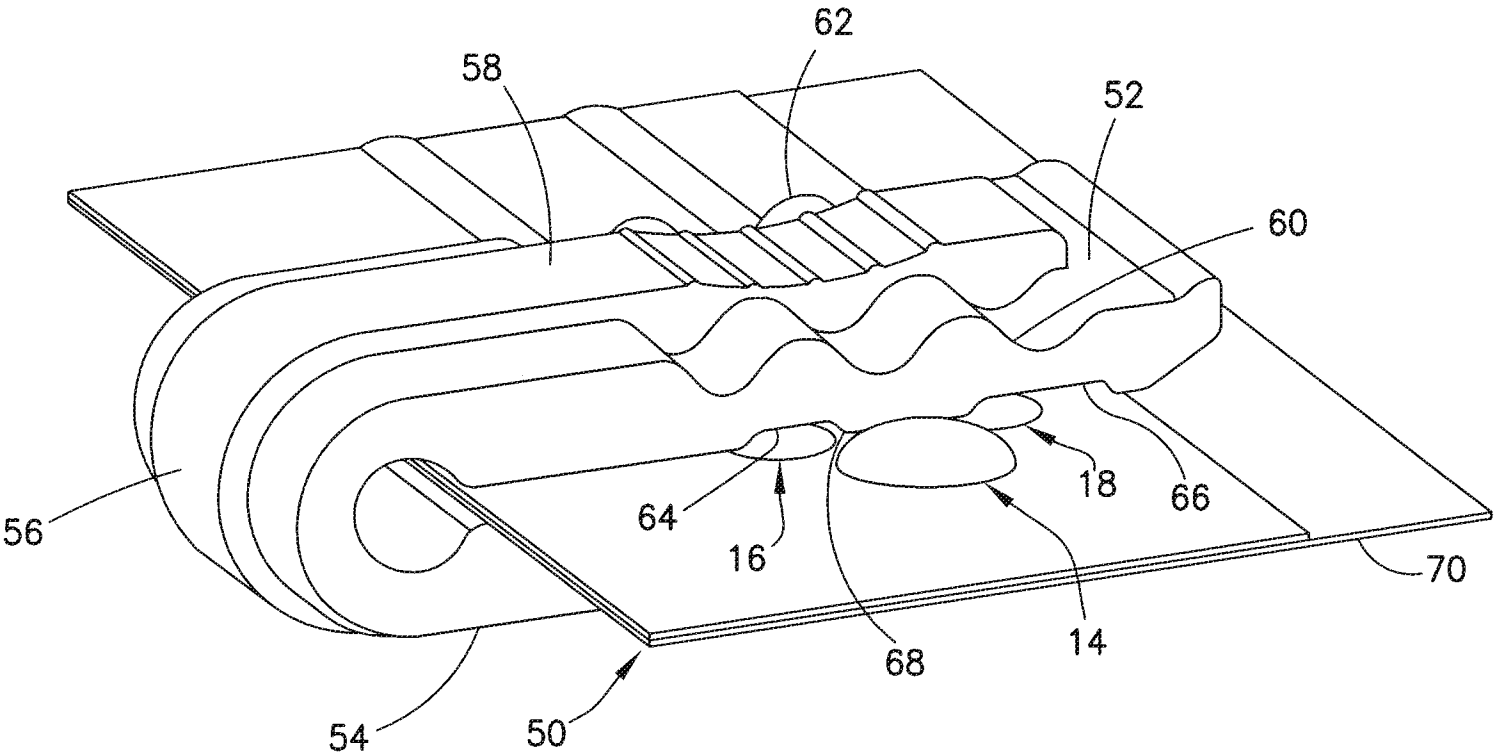
FIG. 3 is a drawing showing an isometric view of a corner at one end of the mouth of a reclosable pouch, which corner has dome-shaped structures for stopping a slider and leak-proof zipper terminations in accordance with one embodiment.

The slider 10 shown in FIG. 3 has a generally U-shaped profile, with respective legs disposed on opposing sides of the two-zipper closure. The gap between the slider legs is small enough that the zippers 8*a* and 8*b* can pass through respective slider gaps only if each zipper is in a closed state. Thus, when the slider 10 is moved along an open closure, this has the effect of pressing the incoming sections of the closure elements together to close the mouth. A suitable slider is disclosed in U.S. Pat. No. 7,490,989. The slider 10 can be made using any desired method, such as injection molding. The slider can be molded from any suitable plastic, such as nylon, polypropylene, polystyrene, acetal, polyketone, polybutylene terephthalate, high-density polyethylene, polycarbonate, or ABS.

In accordance with the embodiment depicted in FIG. 3, each of the pouch corners at opposing ends of the closure has respective dome-shaped structures 44 on opposing sides of the pouch (only one dome is visible in FIG. 3), the distance between the peaks of the oppositely extending domes being sufficiently greater than the width of the gap between those contacting portions of the slider legs that the slider is stopped and cannot pass over the domes (as depicted in FIG. 3). Thus, FIG. 3 shows the slider 10 at the limit of its travel along the closure. The slider can travel no further in the direction of the dome due to the dome-shaped obstacles 44 in its path and thus is prevented from falling off of the pouch.

As seen in FIG. 3, the slider 10 is generally U-shaped and comprises mutually opposing sidewalls 52 and 54, a bridge 56 connecting the sidewalls 52 and 54, and a generally U-shaped stiffening rib 58 projecting outward from sidewalls 52, 54 and bridge 56. The sidewalls 52 and 54 are separated by a gap of varying width. In FIG. 3, the gap is not visible due to the presence of the pouch corner 50 therein. Preferably the slider is made by injection molding, so that the stiffening rib is integral with the sidewalls and bridge. On one side of the stiffening rib 58, the sidewalls and bridge form a first generally clip-shaped structure 60 having undulating external surfaces. On the other side of the stiffening rib 58, the sidewalls and bridge form a second generally clip-shaped structure 62 that is the same as structure 60.

Each sidewall 52, 54 of the slider has a pair of mutually parallel linear grooves 64 and 66 (only the grooves of sidewall 52 are visible in FIG. 3). The grooves 64 and 66 of sidewall 52 respectively oppose identical grooves on the other sidewall. These grooves ride on the tracks formed by the interlocked closure elements of zippers 8*a* and 8*b* as the slider travels from one pair of dome-shaped slider end stops at one end of the zipper to the other pair of dome-shaped slider end stops at the other end of the zipper. These grooves cam the closure elements of the incoming zipper section into engagement when the slider is moved along the zippers in either direction, thereby hermetically sealing the pouch mouth.

The grooves 64 and 66 define a plateau or ridge 68 therebetween, as seen in FIG. 3. An identical plateau on the other sidewall is not visible in FIG. 3. The opposing plateaus 68 form a gap that is less than the combined height of the oppositely projecting back-to-back domes 44. The domes 44 are placed so that they lie in the path of plateaus 68 as the slider approaches the domes. Thus, the ends of the plateaus 68 will abut the domes 44 on respective sides of the pouch corner 50 when the consumer pulls the slider toward the pouch side edge 70. In this embodiment, a single point of contact occurs between each of the plateaus 68 and the domes 44 as the ends of the plateaus 68 abut the domes 44 on respective sides of the pouch corner 50. The slider 10 and the domes 44 are sufficiently rigid and the difference between the plateau gap and the dome combined height is sufficiently great that the opposing plateaus 68 cannot easily pass over the domes 44 after they come into contact.

In accordance with the embodiment depicted in FIG. 3, each of the pouch corners at opposing ends of the closure also has respective pairs of half dome-shaped projections 46 and 48 arranged back to back on opposing sides of the pouch (only one pair of these projections is visible in FIG. 3). Alternatively, projections 46 and 48 may be dome-shaped or having any shape intermediate a half dome and a full dome. The distance between the peaks of back-to-back projections 46 and 48 is sufficiently greater than the width of the gap between the plateaus 68 that, when the slider has been stopped by domes 44 as depicted in FIG. 3, the back-to-back projections 46 and 48 pose respective obstacles to upward and downward movement of the plateaus 68 while they are in contact with domes 44. In the embodiment depicted in FIG. 3, at least part of each projection 46 or 48 has the shape of a half-dome with a rounded half-circumference facing away from the respective uncrushed closure element, the back side of each pair of back-to-back half dome-shaped projections being integrally connected and hermetically sealed to respective uncrushed core elements, thereby providing leakproof transitions from uncrushed closure element to crushed closure element at the ends of the zippers over an angle of at least 180 degrees relative to the end of the uncrushed closure element.

Figure 4:
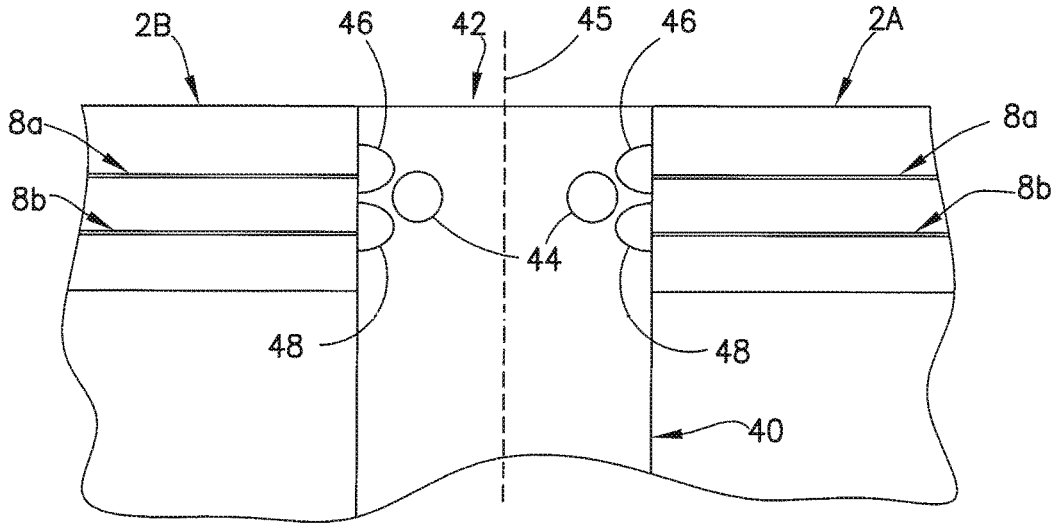
FIG. 4 is a drawing showing a plan view of a portion of two connected pouch precursors in process, the depicted portion including an area where the interlockable closure elements have been crushed and then the plastic material in the crush area has been deformed to make slider end stops and zipper terminations of the types depicted in FIG. 3.

FIG. 4 is a plan view showing one side of a portion of two connected pouch precursors in process, the depicted portion including a transverse rectangular area 40 where two sheets of bag making film have been heat sealed together and an area 42 where the closure elements have been crushed and then the plastic material in the crush area has been formed into a pair of slider end stops 14 and respective pairs of zipper terminations 16 and 18. The dashed line 45 in FIG. 4 indicates where the transverse heat seal 40 and the crush area 42 will be cut, thereby severing a completed pouch on one side of cut line 45 from the chain of pouch precursors on the other side of cut line 45.

Each transverse heat seal 40 is made wide enough so that respective halves of the heat sealed area can be incorporated into separate pouches. More specifically, the cross-sealed area 40 is bisected by cutting along a line 45 transverse to the closure 8. The area to the right of the cut line 45 forms the trailing side seal of the leading pouch precursor 2A (assuming advancement of the chain of pouch precursors from left to right in FIG. 4), while the area to the left of the cut line 45 forms the leading side seal of the trailing pouch precursor 2B.

As seen in FIG. 4, the centers of the round slider end stops 14 are located along a line that is parallel to and, if extended, would be located midway between the closure elements of zippers 8*a* and 8*b*. Although the slider end stops 14 and the zipper terminations 16 and 18 shown in FIG. 4 appear to share a common tangent T that is parallel to the transverse cut line 45, the tangent common to zipper terminations 16 and 18 may be separated from the nearest parallel line that would be tangent to dome 14*a* by a small distance (e.g., a few hundredths of an inch in some implementations). The centerlines of zipper terminations 16 and 18 are separated by a distance equal to the distance between the centerlines of the male closure elements of zippers 8*a* and 8*b*.

Figure 5:
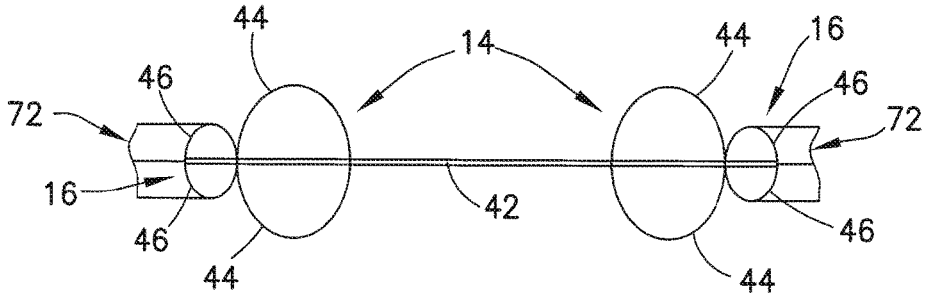
FIG. 5 is a drawing showing a top view of the zipper crush area depicted in FIG. 4.

FIG. 5 shows a top view of the zipper crush area 42 depicted in FIG. 4. As can be seen in FIG. 5, the zipper crush area 42 has two pairs of back-to-back domes 44 and two upper pairs of back-to-back half dome-shaped projections 46 on both sides (i.e., front and back) of the pouch. The two lower pairs of back-to-back half dome-shaped projections (items 48 in FIG. 4) on both sides (i.e., front and back) of the pouch are not visible in FIG. 5. Each pair of domes 44 are disposed back to back to form a respective slider end stop 14. The half dome-shaped projections (items 46 and 48 in FIGS. 4 and 5) are similarly disposed back to back to form zipper terminations 16 and 18, which serves as leakproof transitions from uncrushed portions 72 of the interlocked closure elements to adjacent areas where portions of the same interlocked closure elements have been crushed.

The pouch described above can be manufactured on an automated production line. For example, two webs of thermoplastic material, having the same width, can be paid out from respective rolls. Downstream respective sets of pull rollers are provided for pulling the webs through the pouch making machine. At the same time, continuous lengths of the zipper strips depicted in FIG. 2 are paid off respective spools and advanced to respective stations whereat the backs of the zipper strips are positioned in overlying relationship with the marginal portions of the respective webs of bag making film. Typically, the webs and the zipper strips are advanced intermittently and all manufacturing operations are performed during dwell times. At a pair of parallel sealing stations, the zipper strips are joined to the respective webs in a well-known manner, for example, by conductive heat sealing (see heat seals 36 and 38 in FIG. 2). Then, the webs with attached zipper strips are brought together in a manner that causes the respective webs to overlap and the closure elements of the respective zipper strips to interlock. (Alternatively, the interlocked zipper strips could be placed between the overlapping webs of bag making film and joined to webs in one operation). At the next station, the marginal web portions on the side opposite the zippers (which portions will become the bottom of the pouches) are heat sealed to form collapsible channels for venting air when the pouch contents are compressed. A teaching of this operation can be found in International Patent Application No. PCT/US11/57389 filed on Oct. 21, 2011. At the next station, transverse heat seals are formed across the two webs, which seals will become the pouch side seals after being bisected during a cutting operation. Between each transverse heat sealing operation, the webs are advanced by a distance equal to one pouch width. In accordance with one implementation, the work in process then advances in succession through four stations where the crush area 42 with dome-shaped slider end stops and zipper terminations (see FIG. 4) is formed in stages. Within the crush zone 42, the closure elements are thermally crushed, i.e., flattened, and then the crushed zipper material is deformed in the protruding shapes depicted in FIG. 5.

FIGS. 6 through 11 show four different tools that are employed in pairs at four successive stations of an automated production line for making reclosable pouches, these tools are utilized to form the structures depicted in FIGS. 3, 4, and 5. These successive stations will hereafter be respectively referred to (in order) as the zipper crush station, the zipper stepped crush station, the slider end stop pre-forming station, and the slider end stop post-forming station. Each of these stations comprises a stationary tool and a reciprocating tool that are arranged in a mutually confronting relationship. The reciprocating tool alternately extends and retracts toward and away from the stationary tool, with the work in process therebetween. When the reciprocating tool is fully extended, the work surfaces of the opposing tools at each station shape the plastic zipper material in contact therewith. However, the work surfaces of the opposing tools, which are the same for each pair, have a different geometry for each station, as explained in detail hereinafter. Each tool can be made from heat-treated A-2 tool steel or other suitable metal alloy.

Figure 6:
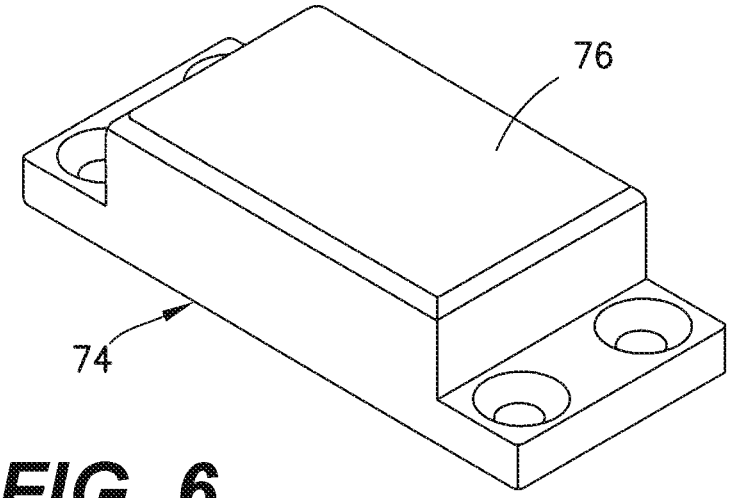
FIG. 6 is an isometric view of a tool that is one of two opposing tools used at a first crush station for crushing intervening plastic material of a work in process after each indexed advance thereof.

The zipper crush station comprises two mutually confronting tools of the type 74 depicted in FIG. 6. Each tool 74 (only one of which is shown in FIG. 6) comprises a heated rectangular metal block having a rectangular planar contact surface 76 and rounded edges along the perimeter of planar surface 76. The planar contact surfaces 76 of opposing tools 74 are pressed together with a section of the interlocked plastic zipper strips (with attached bag film) therebetween. The temperature between the contacting surfaces and the resulting pressure applied are controlled to at least partially crush the male and female closure elements. After each crushing cycle, the work in process is advanced on pouch width and then the crushing operation is repeated on a different section of the interlocked plastic zipper strips.

Figure 7:
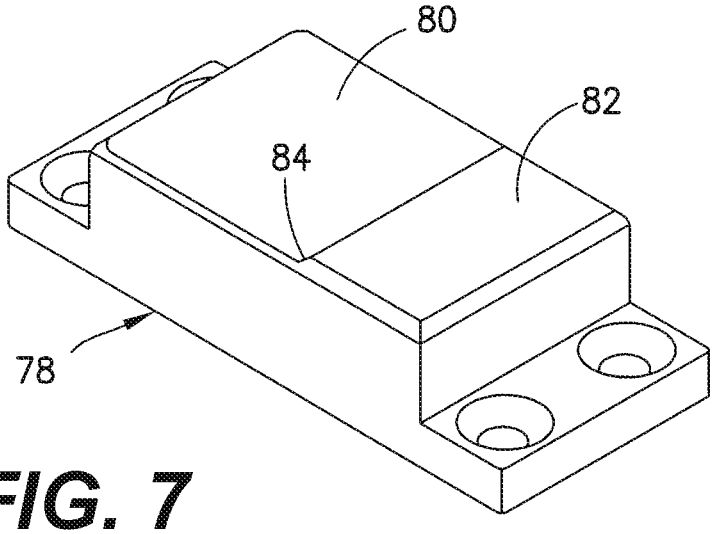
FIG. 7 is an isometric view of a stepped tool that is one of two opposing tools used at a second crushing station to further crush the plastic material previously crushed at the first crush station after each indexed advance.
Figure 8:
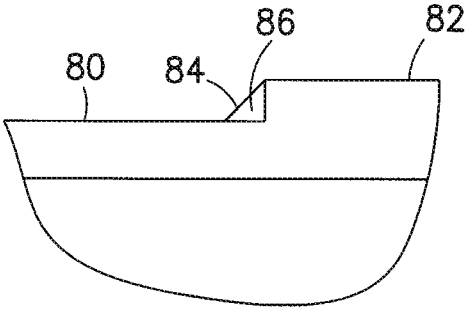
FIG. 8 is a diagram showing an isometric view of one end of the stepped portion of the tool depicted in FIG. 7.

The second (stepped) zipper crush station comprises two mutually confronting tools of the type 78 depicted in FIGS. 7 and 8. Each tool 78 (only one of which is shown in FIG. 7) comprises a heated rectangular metal block having a rectangular stepped face and rounded edges along the perimeter of the stepped face. The stepped face comprises a rectangular planar surface 80, a stepped rectangular planar surface 82, and a beveled surface 85 (e.g., with a bevel angle of forty-five (45) degrees) that connects to planar surfaces 80 and 82. As seen in FIG. 8, there is a triangular facet 86 at each end of beveled surface 84 instead of a rectilinear corner.

The stepped planar surfaces 82 of opposing tools 78 are pressed together with a minor portion of the zipper crush zone therebetween. The temperature between the contacting surfaces and the resulting pressure applied are controlled to cause some of the plastic zipper material to flow in the compressed zone to flow toward the lower portion of the closure. This downward displacement of plastic material provides additional material for the formation of slider end stops and zipper terminations in the central portion of the closure during subsequent operations. After each stepped crushing cycle, the work in process is advanced one pouch width and then the stepped crushing operation is repeated on a different crushed section of the work in process.

Figure 9:
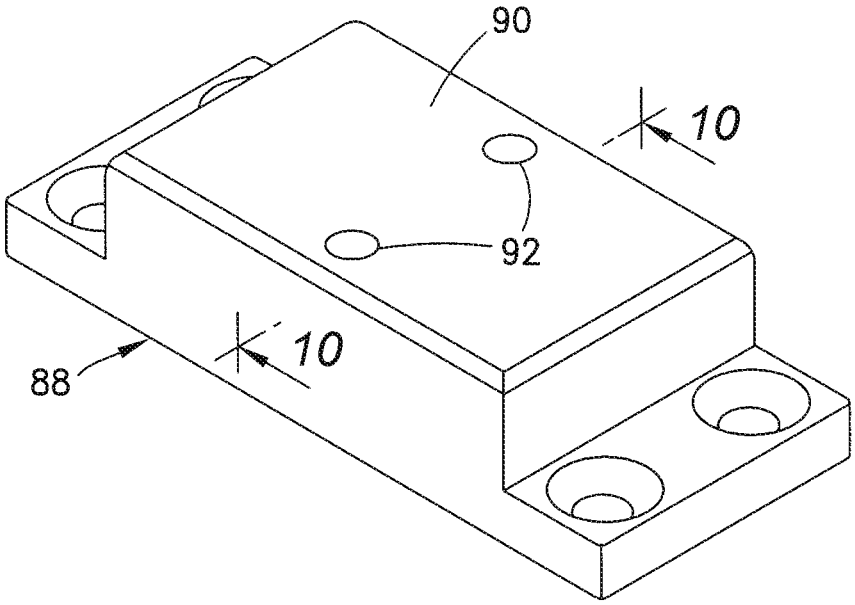
FIG. 9 is a diagram showing an isometric view of a tool having two dimples that is one of two opposing tools used at a pre-forming station for forming crushed plastic material into respective dome shapes that project on both sides of the work in progress.
Figure 10:
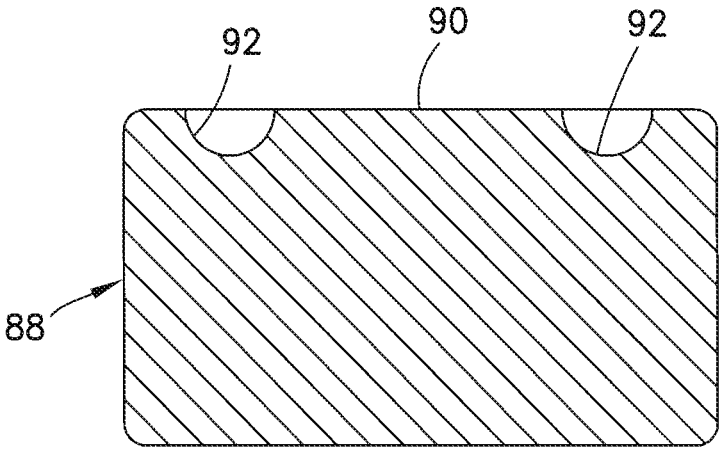
FIG. 10 is a diagram showing a cross-sectional view of the tool depicted in FIG. 9, the section being taken along a plane 10-10 that bisects the two dimples.

The slider end stop pre-forming station comprises two mutually confronting dies of the type 88 depicted in FIGS. 9 and 10. Each die 88 comprises a heated rectangular metal block having a dimpled face and rounded edges along the perimeter of the dimpled face. The dimpled face comprises a rectangular planar surface 90 and a pair of preferably identical hemispherical depressions 92 (hereafter "dimples") positioned as shown. The dimples 92 are shown in mid cross section in FIG. 10.

The dimpled faces of opposing dies 88 are pressed together with the crush zone therebetween. The temperature between the contacting planar surfaces 90 and the resulting pressure applied are controlled to cause some of the plastic zipper material to flow into and fully occupy dimples 92. The displaced material in dimples 92 forms respective domes that are precursors of the final slider end stops. After this pre-forming operation, the diameter of these dome-shaped slider end stop precursors will be less than the diameter of the dome-shaped projections on completed pouches. The distance between the centers of dimples 92 is equal to two times the desired distance of the center of each slider end stop to the nearest edge of each completed pouch. After each pre-forming cycle, the work in process is advanced one pouch width and then the pre-forming operation is repeated on a different crushed section of the work in process.

Figure 11:
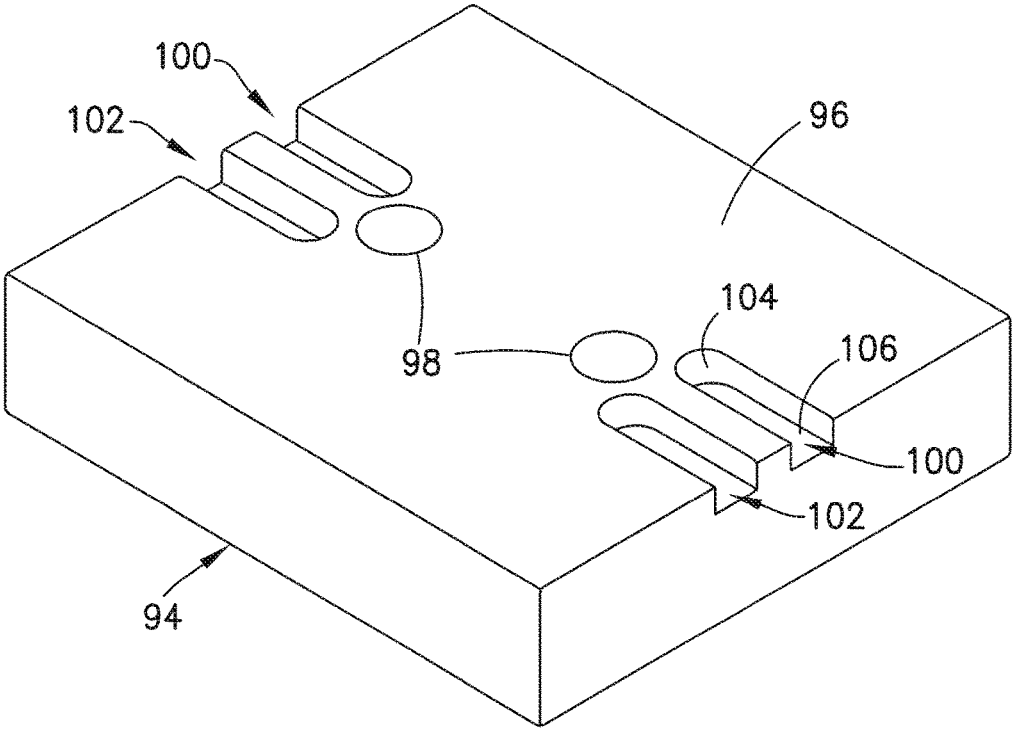
FIG. 11 is a diagram showing an isometric view of a tool having two hemispherical dimples and four zipper termination channels, this tool is one of two opposing tools used at a post-forming station for forming crushed plastic material into respective hemispherical dome shapes that are larger than the pre-formed dome shapes and also forming zipper terminations in the crush area.
Figure 12:
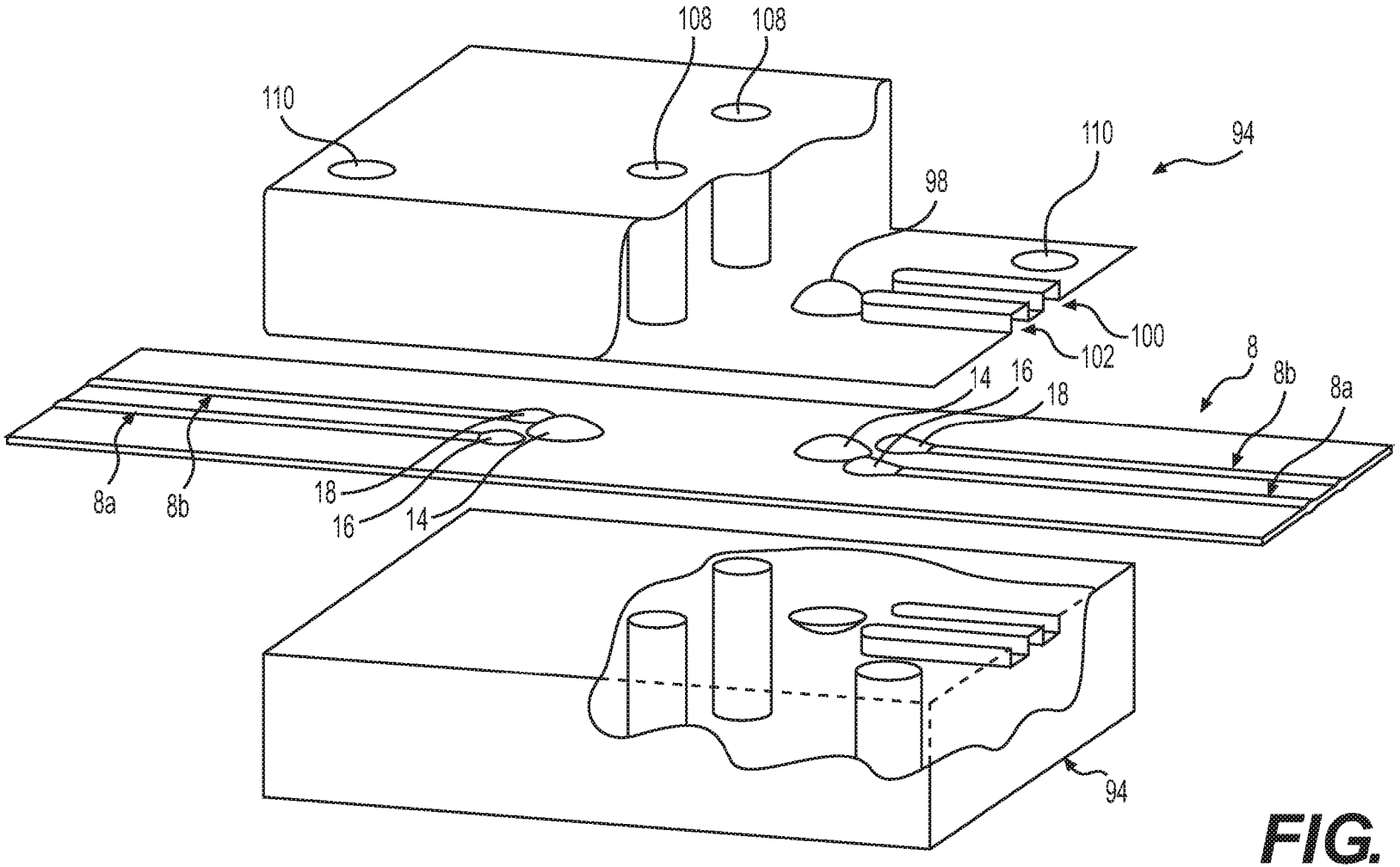
FIG. 12 is a diagram showing an isometric view of two mutually opposing tools of the type depicted in FIG. 11 with portions of the tools being cut away to show the hemispherical dimples and zipper termination channels of the tools, as well as the post-formed section of a zippered portion of work in process therebetween.

The slider end stop post-forming station comprises two mutually confronting dies of the type 94 depicted in FIGS. 11 and 12. Each die 94 comprises a cold rectangular metal block having a rectangular contact face surrounded by rounded edges. The dies 94 can be cooled by a cold air gun directed at the dies or by coolant from a chiller that circulates in channels formed in the dies. The rectangular contact face of each die 94 comprises a rectangular planar surface 96, a pair of preferably identical hemispherical depressions 98 (hereafter "dimples") positioned as shown, and two pairs of zipper termination channels, each pair including an upper channel 100 and a lower channel 102. The zipper termination channels of each pair are mutually parallel to a hypothetical line connected to the centers of dimples 98 and extend from a respective one of opposing sides of the die 94. In accordance with the embodiment shown in FIG. 11, each zipper termination channel comprises a channel wall 104 that is semicircular at the closed end of the channel and a flat bottom 106 that extends to an open end of the channel. The channels 100 and 102 provide clearance for the zipper profiles during formation of the slider end stops. During this operation, zipper material tends to flow into these channels at their closed ends. The surface tension of the molten zipper material tends to cause the material in channels 100 and 102 to form round projections, such as the dome-shaped projections 46 and 48 seen in FIG. 4. The centerlines of channels 100 and 102 are separated by a distance equal to the distance between the midpoints of the male closure elements on the closure.

The faces of opposing dies 94 are pressed together within the crush zone, now with slider end stop precursors, therebetween. The dimples 98 on dies 94 are aligned with the slider end stop precursors (not shown in FIG. 11) so that the latter are received in the former, but with empty space between the slider end stop precursor surfaces and the surfaces of depressions 98. The pressure exerted by the contacting planar surfaces 96 is sufficient to cause some of the plastic zipper material to flow into and fully occupy the empty spaces inside dimples 98. The additional displaced material fills dimples 98 to form respective domes that will serve as slider end stops in the completed pouch after the plastic has cooled. In addition, plastic zipper material flows into the rounded ends of channels 100 and 102 and, upon cooling, will form zipper terminations having rounded or partially rounded shapes.

FIG. 12 shows the separated dies 94 after the slider end stops 14 and zipper terminations 16, 18 have been formed on closure 8. To avoid clutter in the drawings, FIG. 12 does not show the pouch walls that are sealed to the backs of respective zipper flanges of closure 8, as seen in FIG. 2. As seen in FIG. 12, each die 94 has a pair of threaded bores 108 spaced apart in a central section and a pair of unthreaded bores 110 at diagonally opposed corners. The unthreaded bores 110 of each die 94 receive respective alignment pins projecting from a respective die support plate (not shown) installed at the post-forming station, while each die 94 is affixed to the respective die support plate by means of threaded bolts received in threaded bores 108.

After each post-forming cycle, the work in process is advanced one pouch width and then the post-forming operation is repeated on a different crushed section of the work in process. At the next station (see FIG. 4), the distal pouch precursor 2A is severed from the adjacent pouch precursor 2B by cutting along line 45.

Alternatively, the chain of pouch precursors (each pouch precursor having slider end stops and zipper terminations as described above) could be wound on a roll (i.e., without cutting) for transport to a cutting station. Thus, it is within the scope of this invention to not sever each completed pouch at the leading end of the chain of pouch precursors and instead to wind the chain of pouch precursors on a roll for transport to another location. At such other location, the connected pouch precursors can be unwound from the roll and severed to form individual pouches.

Figure 13:
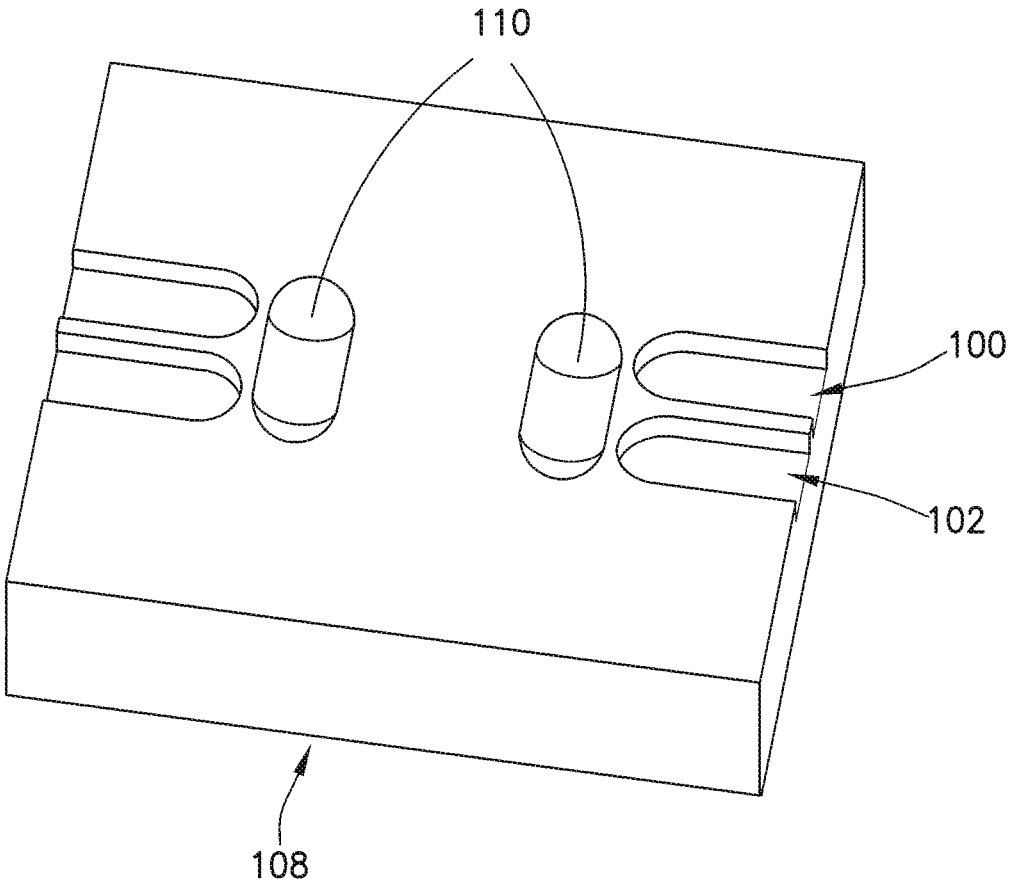
FIG. 13 is a diagram showing an isometric view of a tool having two oval-shaped dimples and four zipper termination channels, this tool is one of two opposing tools used at a post-forming station for forming crushed plastic material into respective oval-shaped domes of sufficient height to stop the slider at the ends of the double zipper.
Figure 14:
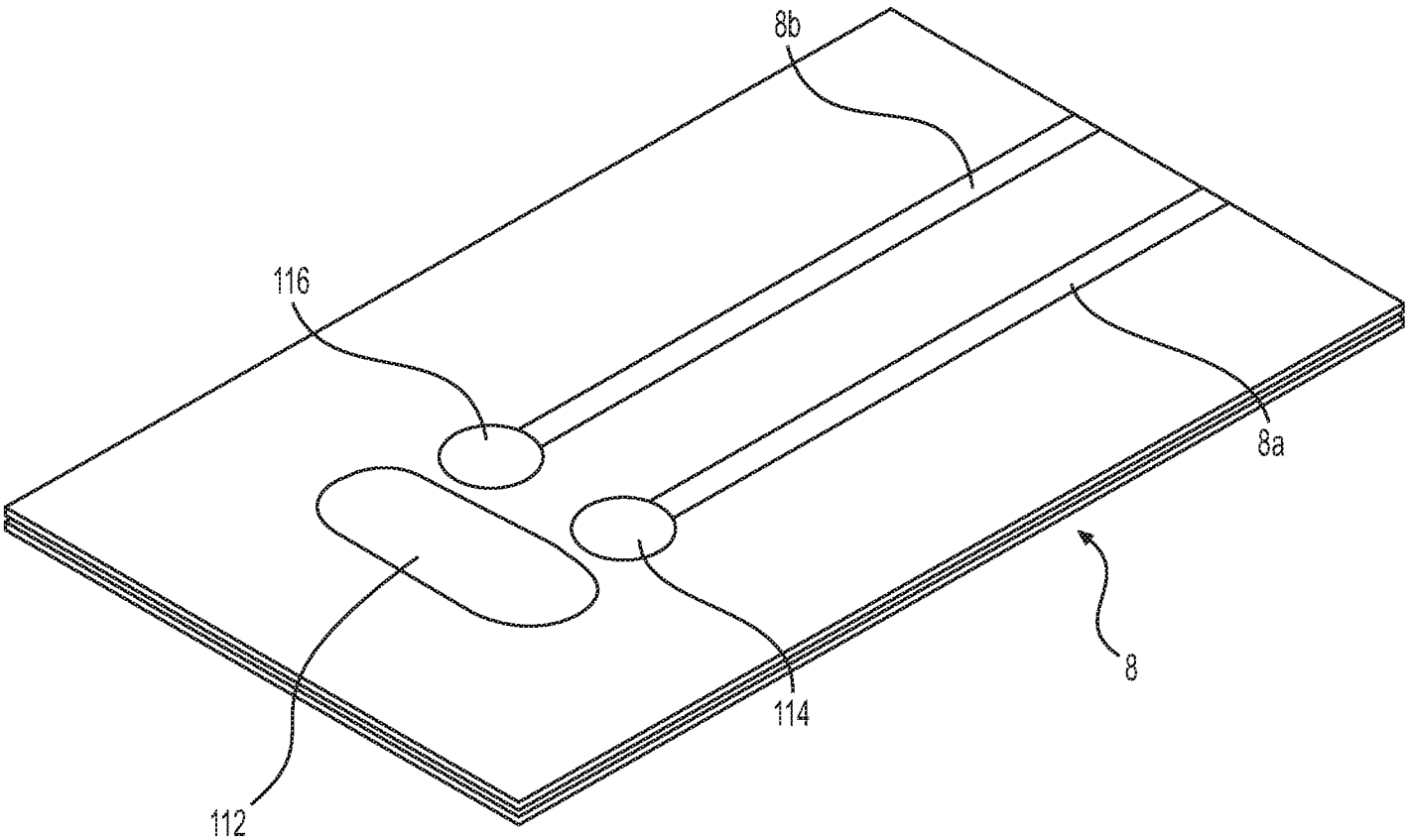
FIG. 14 is a diagram showing an isometric view of a corner at one end of the mouth of a reclosable pouch made using dies of the type depicted in FIG. 13.
Figure 15:
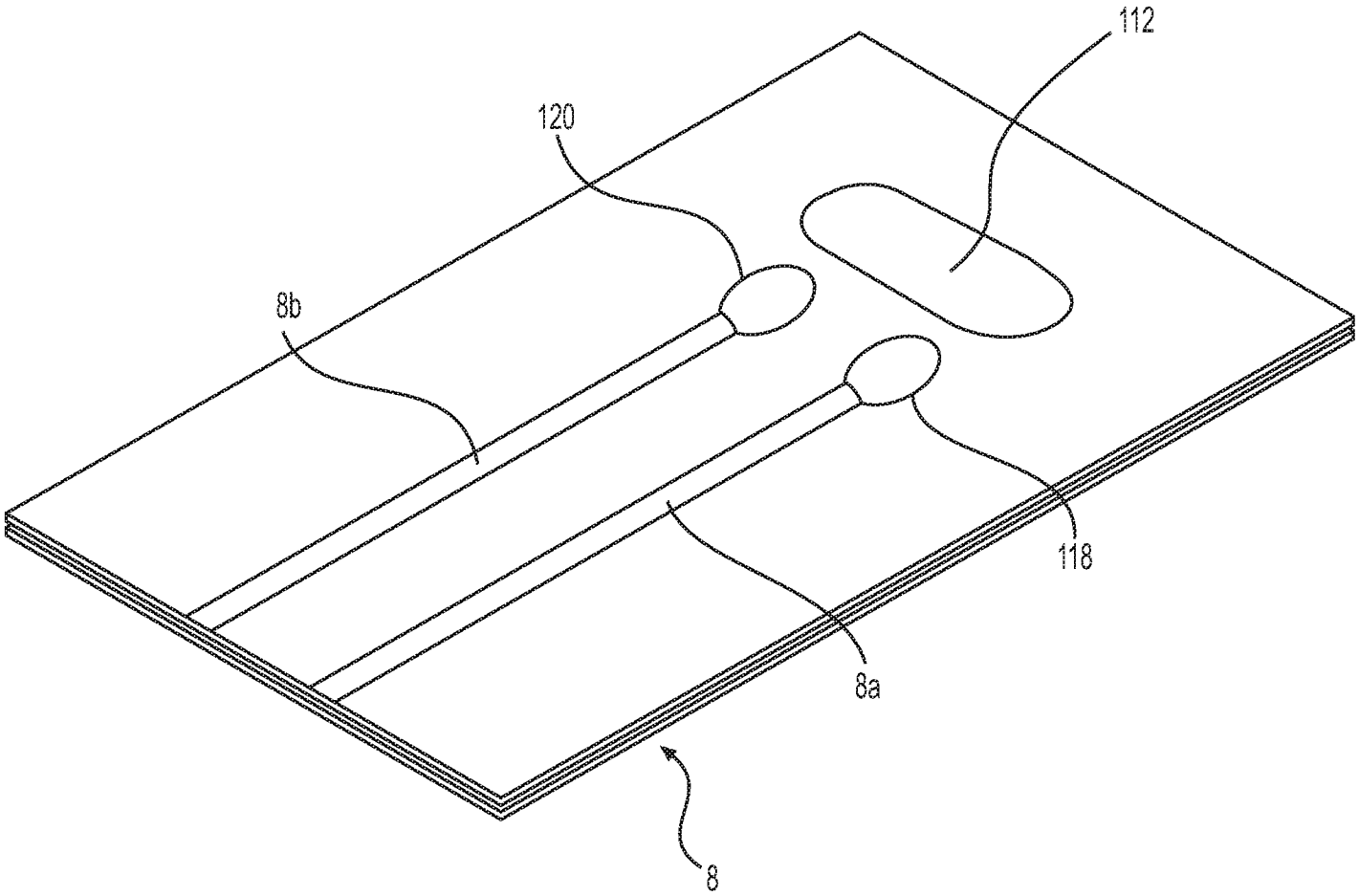
FIG. 15 is a diagram showing an isometric view of a corner at one end of the mouth of a reclosable pouch having oval-shaped slider end stops and oval-shaped zipper terminations in accordance with an alternative embodiment.

In accordance with an alternative embodiment, the dome-shaped slider end stops may be oval, not circular. FIG. 13 shows a die 108 having two oval-shaped dimples 110 and two pairs of zipper termination channels 100 and 102, which die is one of two opposing dies used at a post-forming station for forming crushed plastic material into respective oval-shaped domes of sufficient height to stop the slider at the ends of the double zipper. The result crush zone structure is shown in FIG. 14. Each upper corner of the pouch has an oval-shaped round projection 112 on both sides of the closure 8 and a pair of dome-shaped zipper terminations 114 and 116. FIG. 15 shows a further alternative embodiment in which the zipper terminations 118 and 120 are oval-shaped, not circular as in FIG. 14.

Figure 16A:
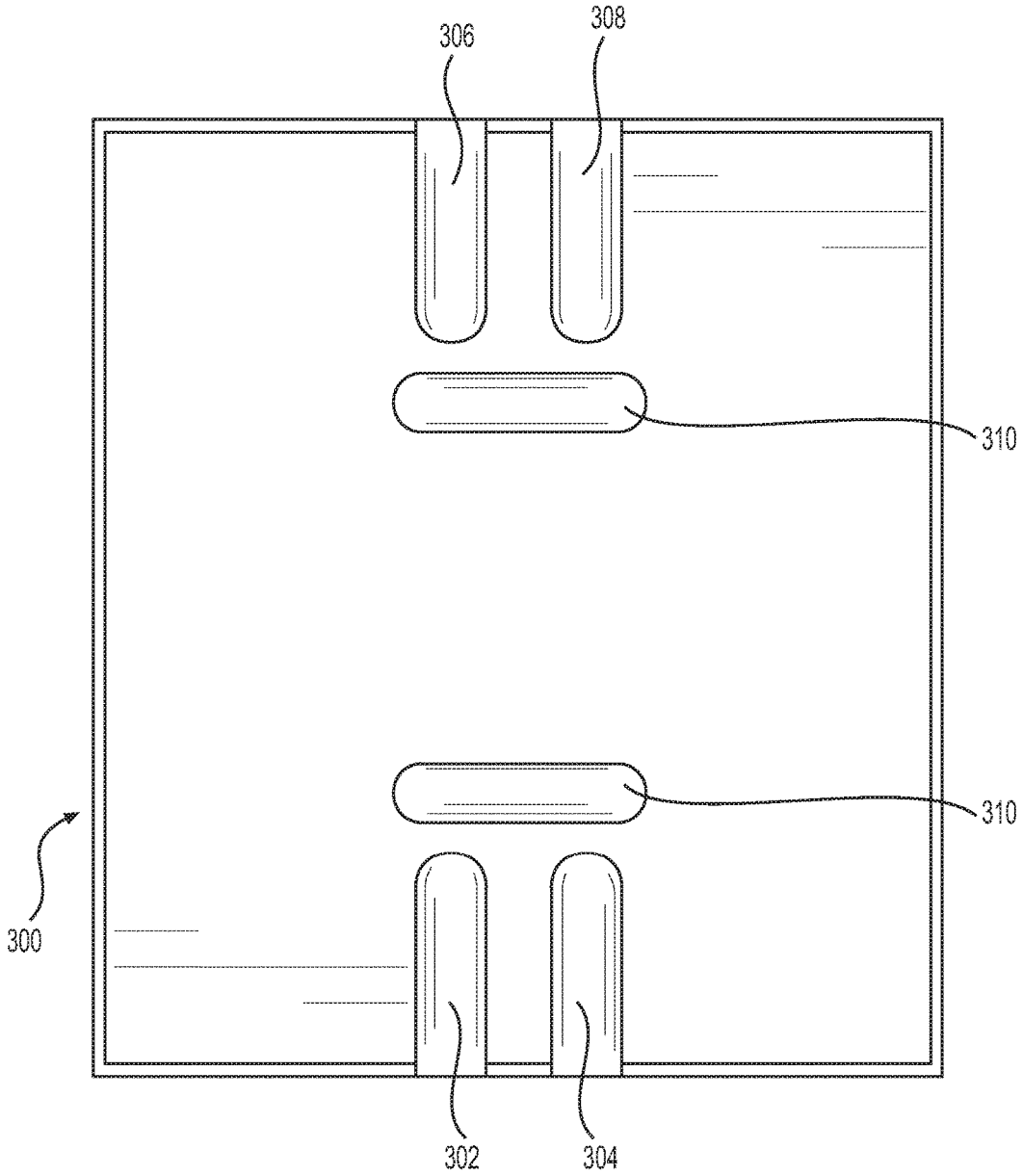
FIG. 16A is a diagram showing a top view of a tool having rectangular dimples and four zipper termination channels, this tool is one of two opposing tools used at a post-forming station for forming crushed plastic material into respective rectangular shapes and also forming zipper terminations in the crush area.
Figure 16B:
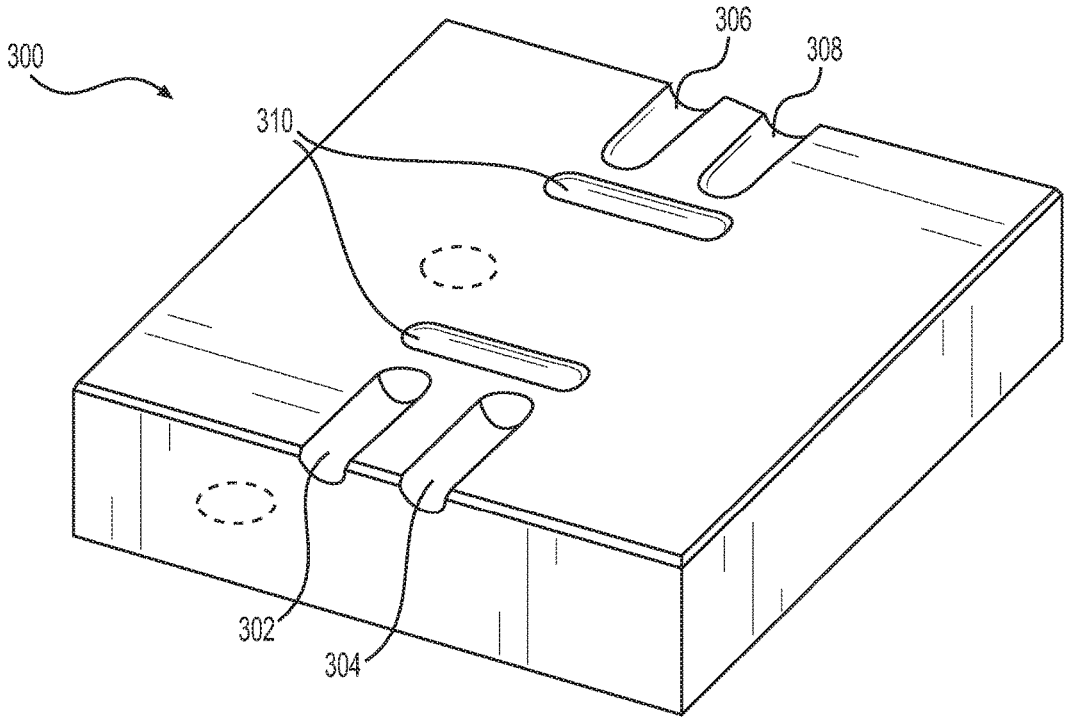
FIG. 16B is a diagram showing an isometric view of the tool depicted in FIG. 16A.

FIGS. 16A and 16B illustrate another embodiment of a die 300 for the slider end stop post-forming station. The die 300 of FIGS. 16A and 16B includes two rectangular dimples 310 and two pairs of zipper termination channels 302, 304, 306, and 308. Each zipper termination channel 302, 304, 306, and 308 comprises a semicircular closed end with a full radius that extends to an open end of the channel. As discussed above, the die 300 is one of two opposing dies used at a post-forming station for forming crushed plastic material into respective rectangular-shaped domes of sufficient height to stop the slider at the ends of the double zipper.

Figure 17A:
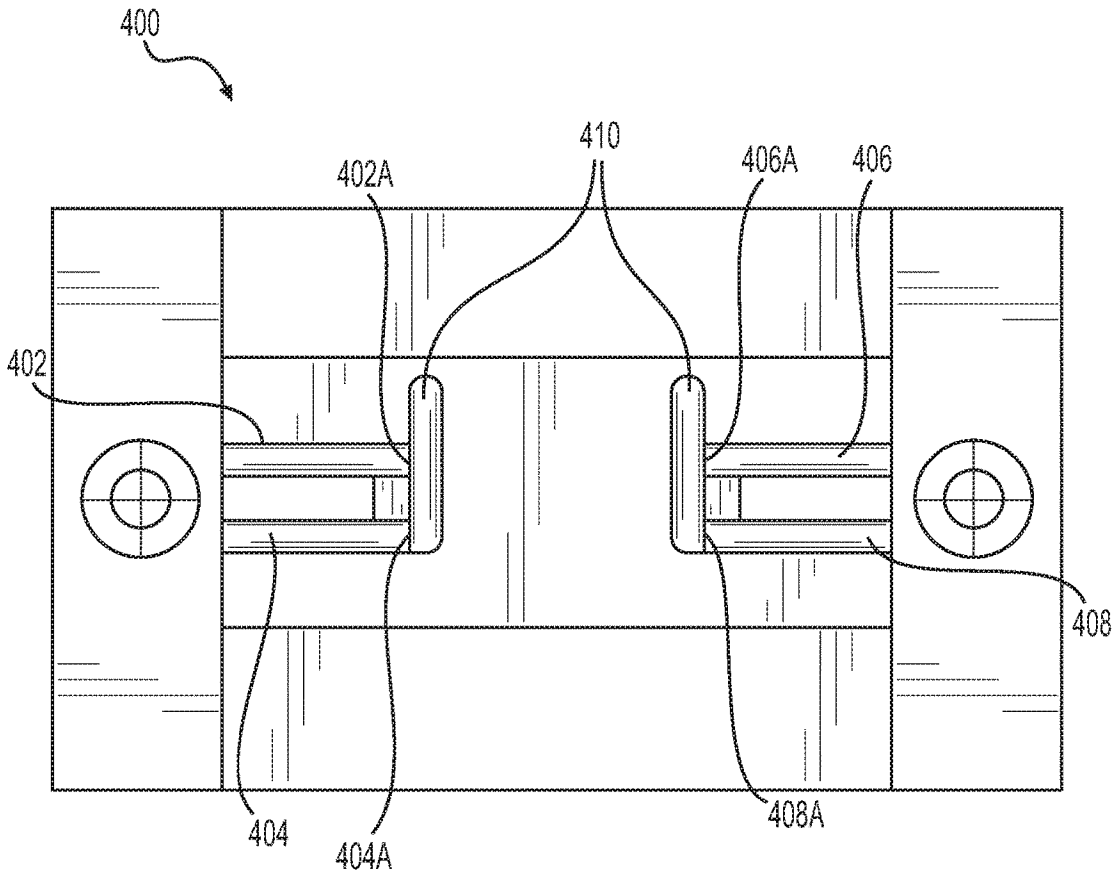
FIG. 17A is a diagram showing a top view of a tool having elongated dimples interconnected with two zipper termination channels, this tool is one of two opposing tools used at a post-forming station for forming crushed plastic material into respective elongated dimple shapes and also forming zipper terminations in the crush area.
Figure 17B:
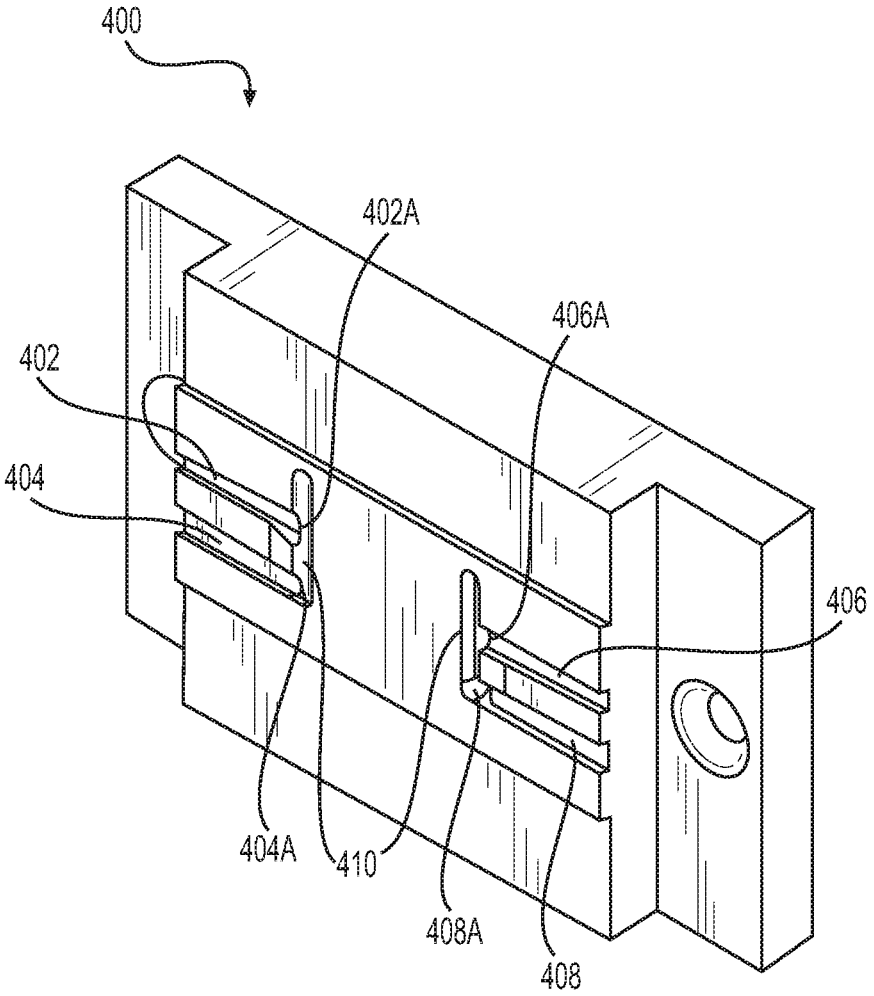
FIG. 17B is a diagram showing an isometric view of the tool depicted in FIG. 17A.
Figure 17C:
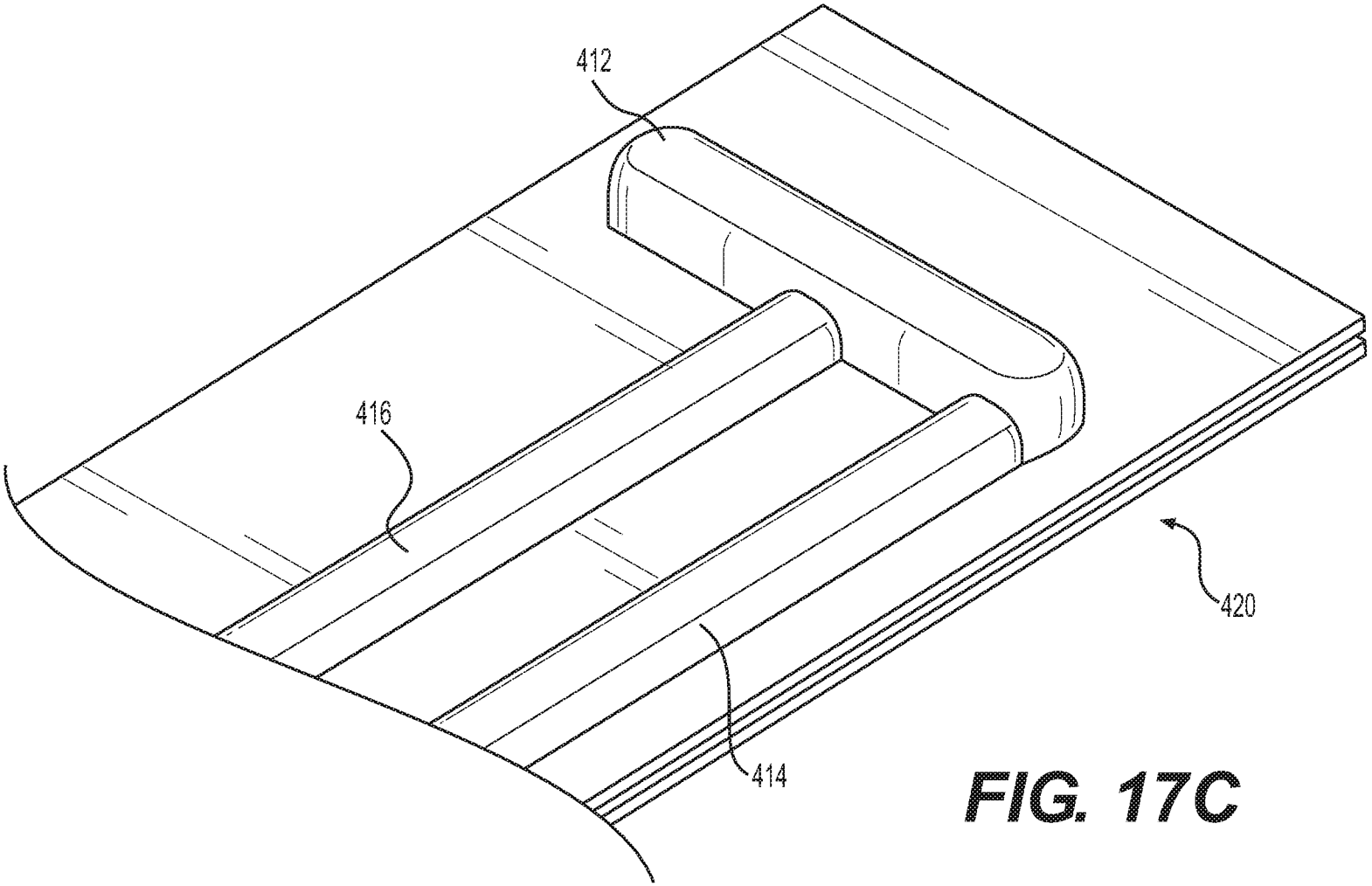
FIG. 17C is a drawing showing an isometric view of a corner at one end of the mouth of a reclosable pouch made using dies of the type depicted in FIGS. 17A and 17B.

FIGS. 17A and 17B illustrate yet another embodiment of a die 400 for the slider end stop post-forming station. The die 400 of FIGS. 17A and 17B includes two elongated dimples 410 that are each connected with a respective pair of zipper termination channels 402, 404, 406, and 408. In the embodiment of FIGS. 17A and 17B, each zipper termination channel 402, 404, 406, and 408 extends into a respective elongated dimple 410, such that a respective portion 402A, 404A, 406A, and 408A of each zipper termination channel 402, 404, 406 and 408 connects to a respective elongated dimple 410. Thus, each slider end stop or elongated dimple 410 comprises three interconnected zipper channels (i.e., 402, 404, 406, 408, and 410). During manufacturing, zipper material tends to flow into these channels and the elongated dimples 410. In accordance with the embodiments discussed above, the die 400 is one of two opposing dies used at a post-forming station for forming crushed plastic material into respective elongated end stops of sufficient height to stop the slider at the ends of the double zipper. The result crush zone structure is shown in FIG. 17C. In one embodiment, this result crush zone structure can, for example, be formed by one of a thermal sealing or "crushing" process and a cold forming process. Each upper corner 420 of the pouch has an elongated projection 412 on both sides of the closure 414, 416 of the double zipper. Although not shown in FIG. 17C, the elongated projection 412 comprises a pair of back-to-back projections in this embodiment. The elongated projection 412, however, does not have to be positioned in a back-to-back configuration. In addition, one or more of the elongated projections 412 could be positioned on one or both of the sidewalls of the pouch. In addition, in this embodiment, the elongated projection 412 extends to a point above the upper closure 416 of the double zipper. The elongated projection 412 also extends to a point at or slightly below the lower closure 414 of the double zipper. The elongated projection 412 could also extend to a point (i) at or above the upper closure 416 and (ii) at or below the lower closure 414 of the double zipper. The placement and/or length of the elongated projection 412, as well as the extension of the elongated projection 412 above and/or below the closures of the double zipper, relate to points of contact that the elongated projection 412 has with a slider. These points of contact and the advantages that they provide will be described in more detail below.

Figure 18A:
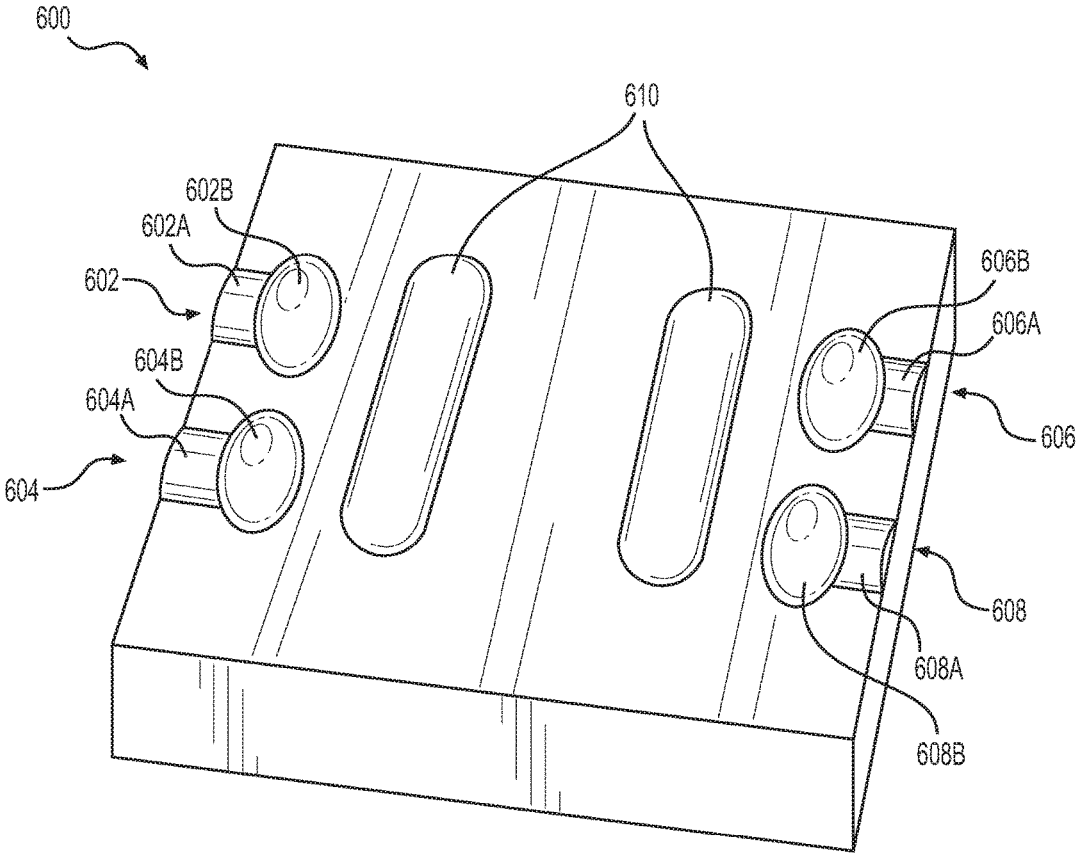
FIG. 18A is a diagram showing an isometric view of a tool having two elongated dimples and four zipper termination channels, this tool is one of two opposing tools used at a post-forming station for forming crushed plastic material into respective elongated dimples and also forming zipper terminations in the crush area.
Figure 18B:
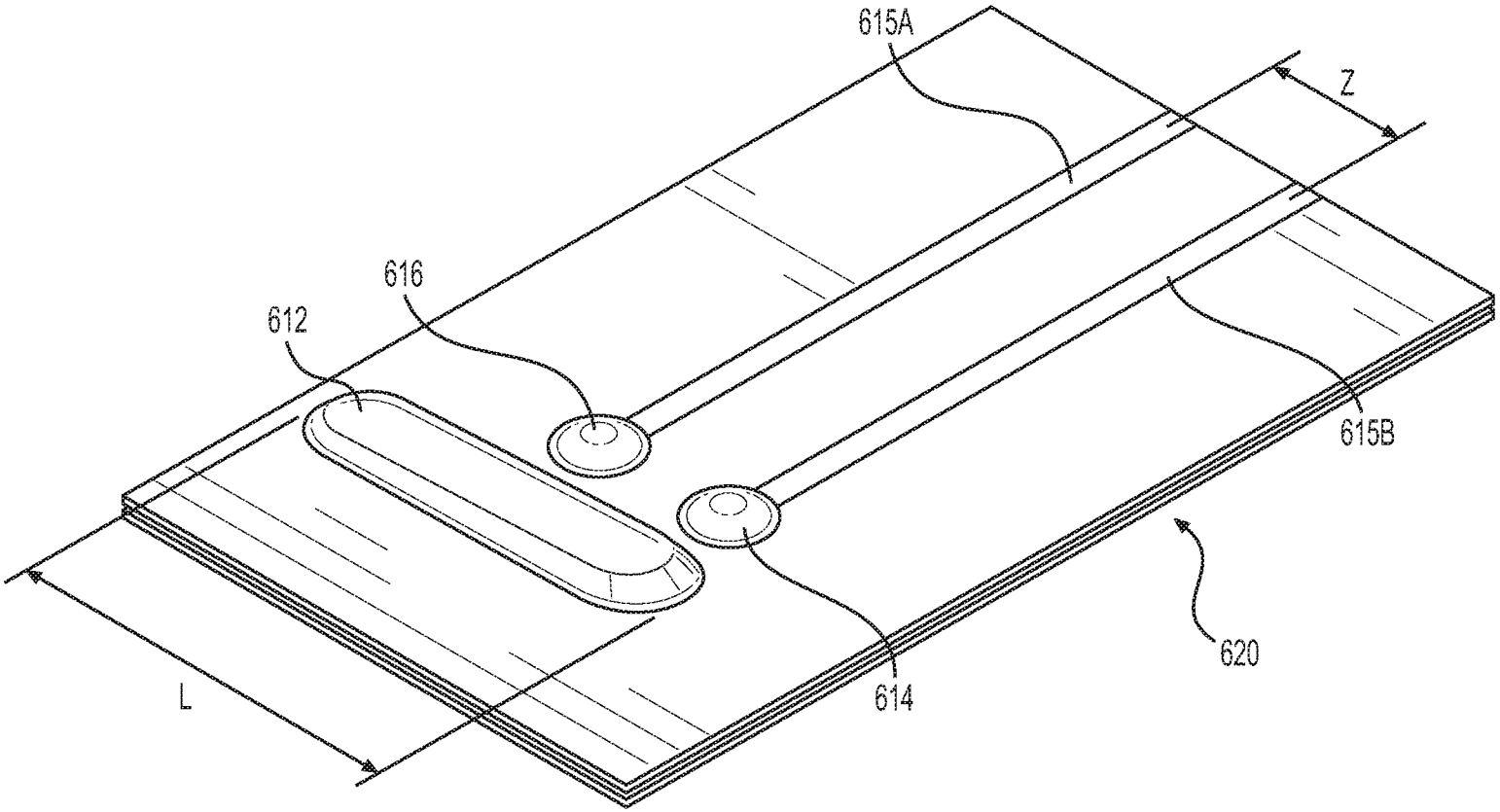
FIG. 18B is a diagram showing an isometric view of a corner at one end of the mouth of a reclosable pouch made using dies of the type depicted in FIG. 18A.
Figure 18C:
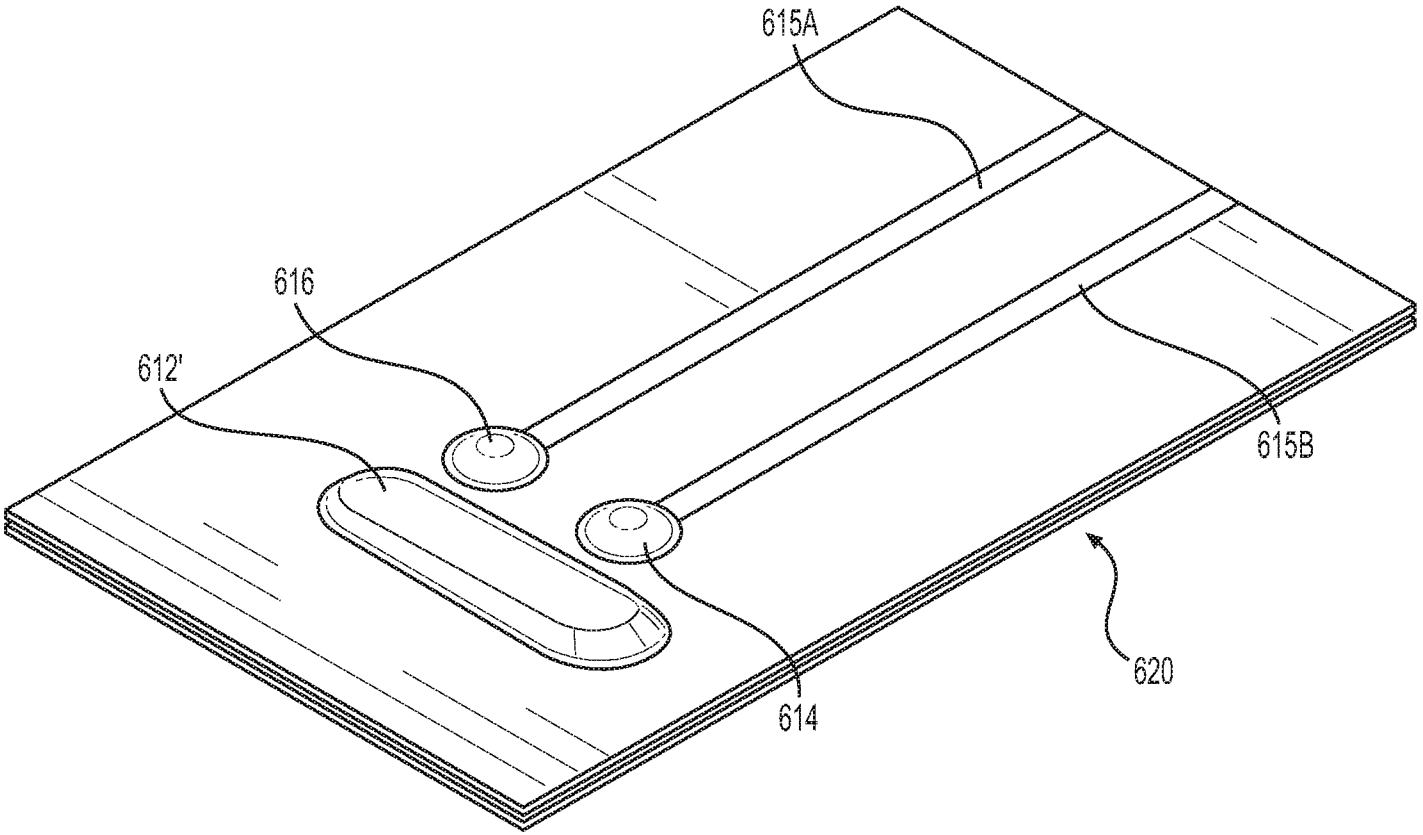
FIG. 18C is a diagram showing an isometric view of a corner at one end of the mouth of a reclosable pouch having an elongated dimple and two zipper termination channels in accordance with an alternative embodiment.
Figure 18D:
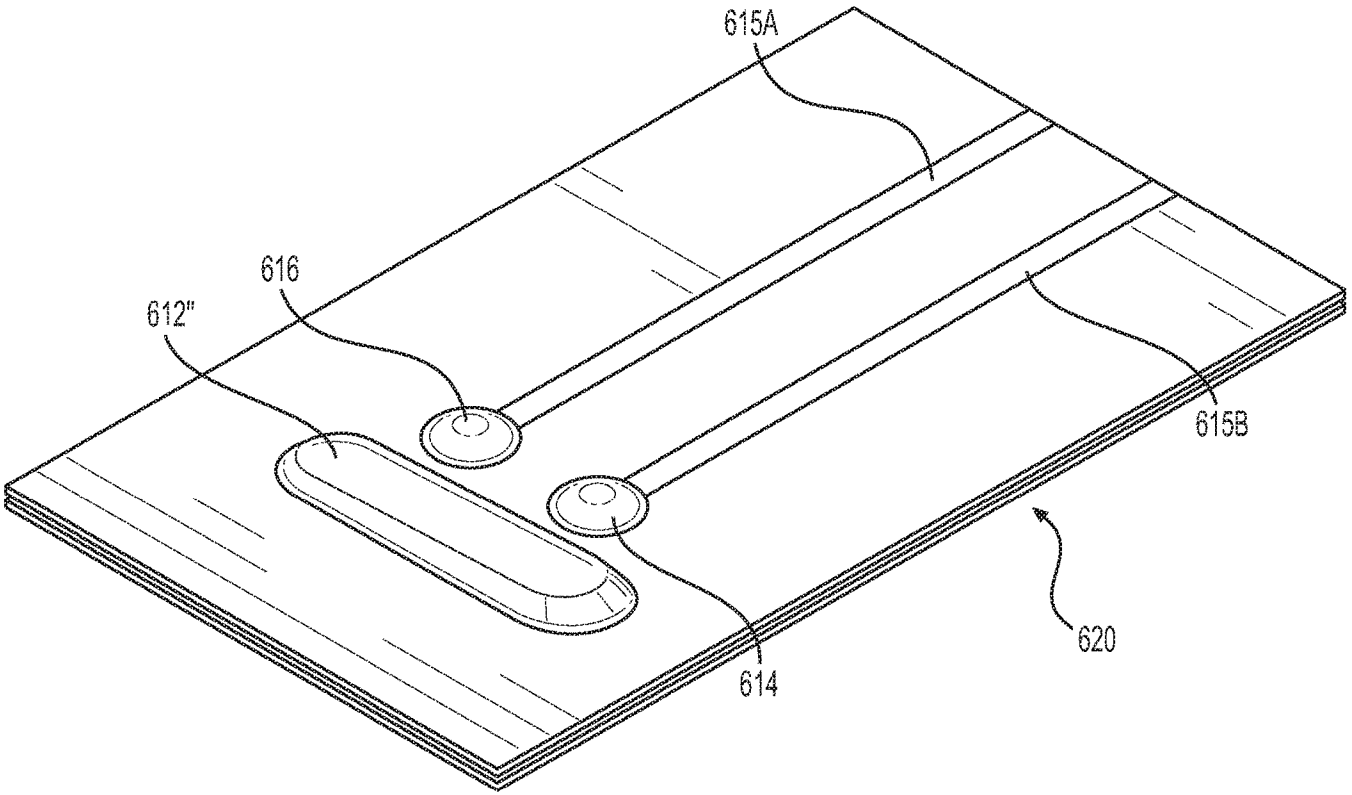
FIG. 18D is a diagram showing an isometric view of a corner at one end of the mouth of a reclosable pouch having an elongated dimple and two zipper termination channels in accordance with another alternative embodiment.

FIG. 18A illustrates yet another embodiment of a die 600 for the slider end stop post-forming station. The die 600 of FIG. 18A includes two elongated dimples 610 and two pairs of zipper termination channels 602, 604, 606, and 608. In the embodiment of FIG. 18A, each zipper termination channel 602, 604, 606, and 608 comprises a circular closed end 602B, 604B, 606B, and 608B that extends to an open end 602A, 604A, 606A, and 608A of the channel. During manufacturing, zipper material tends to flow into these channels and the elongated dimples 610. In accordance with the embodiments discussed above, the die 600 is one of two opposing dies used at a post-forming station for forming crushed plastic material into respective elongated end stops of sufficient height to stop the slider at the ends of the double zipper. The result crush zone structure is shown in FIG. 18B. In one embodiment, this result crush zone structure can, for example, be formed by one of a thermal sealing or "crushing" process and a cold forming process. Each upper corner 620 of the pouch has an elongated projection 612 on both sides of the closure 615A, 615B and a pair of circular or dome-shaped zipper terminations 614 and 616. Alternatively, the zipper terminations 614 and 616 can each comprise a half-domed-shaped projection. While both the elongated projection 612 and the zipper terminations 614 and 616 comprise a pair of back-to-back projections in this embodiment (see, e.g., FIG. 19), the elongated projection 612 and/or the zipper terminations 614 and 616 do not have to be positioned in a back-to-back configuration. In addition, one or more of the elongated projections 612 could be positioned on one or both of the sidewalls of the pouch (see, e.g., FIGS. 18E-G). In the embodiment of FIG. 18B, the elongated projection 612 extends to a point above the upper closure 615A of the double zipper. The elongated projection 612 also extends to a point at or below the lower closure 615B of the double zipper. The elongated projection 612 could also extend to a point (i) at or above the upper closure 615A and (ii) at or below the lower closure 615B of the double zipper. For example, as shown in the embodiment of FIG. 18C, an elongated projection 612' is positioned at the ends of the closures 615A, 615B of the double zipper, with the elongated projection 612' extending to a point (i) at or slightly above the upper closure 615A and (ii) below the lower closure 615B of the double zipper. Alternatively, as shown in the embodiment of FIG. 18D, an elongated projection 612" is positioned at the ends of the closures 615A, 615B of the double zipper, with the elongated projection 612" being evenly spaced between the upper and lower closures 615A, 615B of the double zipper. Thus, in this embodiment, the elongated projection 612" extends to a point (i) above the upper closure 615A and (ii) below the lower closure 615B of the double zipper. In each of these embodiments, the elongated projection 612, 612', and 612" has a length (L) that is at least as long as, and, preferably, greater than the distance of a zipper spacing (Z) measured between a centerline of the upper closure 615A and a centerline of the lower closure 615B of the double zipper (see, e.g., FIG. 18B). For example, in one embodiment, a ratio (L:Z) between the length (L) of the elongated projection 612 and the zipper spacing (Z) is about a 1:1 ratio. This ratio (L:Z), however, could be about a 2:1 ratio, about a 3:1 ratio, about a 3.5:1 ratio, about a 4:1 ratio, about a 5:1 ratio, about a 6:1 ratio, and/or about a 7:1 ratio. In addition, the ratio (L:Z) can range from about a 1:1 ratio to about a 7:1 ratio, and any value in between. In another embodiment, the length (L) is preferably about 2 to about 4 times the distance of the zipper spacing (Z). In one embodiment, the length (L) is preferably greater than about 13.21 mm (0.52 inches). In another embodiment, the length (L) is between about 13.21 mm (0.52 inches) and about 26.67 mm (1.05 inches), preferably, between about 13.21 mm (0.52 inches) and about 18.30 mm (0.72 inches), with a most preferred length (L) of about 13.97 mm (0.55 inches). The placement and/or length of the elongated projection 612, as well as the extension of the elongated projection 612 above and/or below the closures of the double zipper relate to points of contact that the elongated projection 612 has with a slider. These points of contact and the advantages that they provide will be described in more detail below.

Figure 18E:
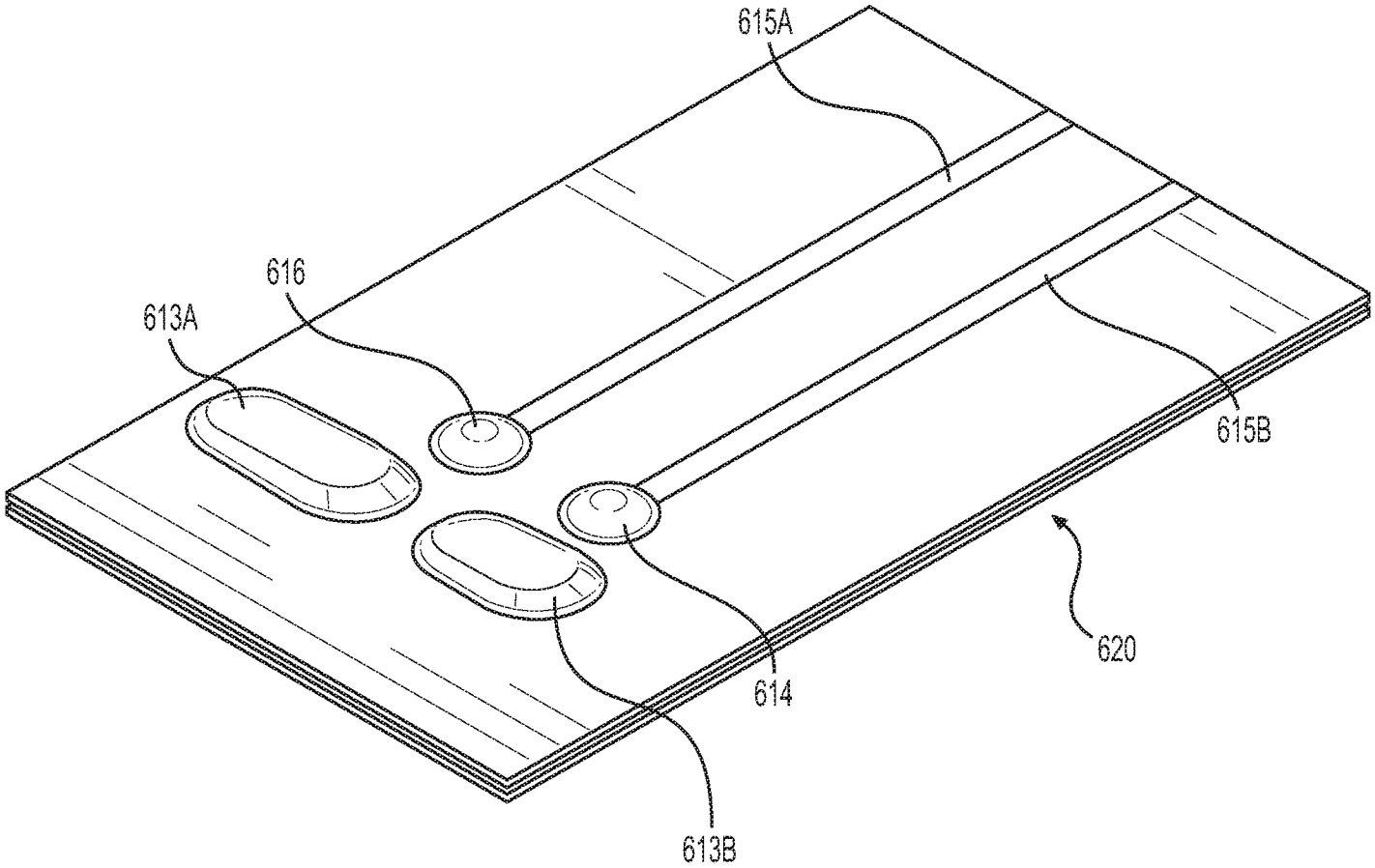
FIG. 18E is a diagram showing an isometric view of a corner at one end of the mouth of a reclosable pouch having a plurality of dimples and two zipper termination channels in accordance with an alternative embodiment.
Figure 18F:
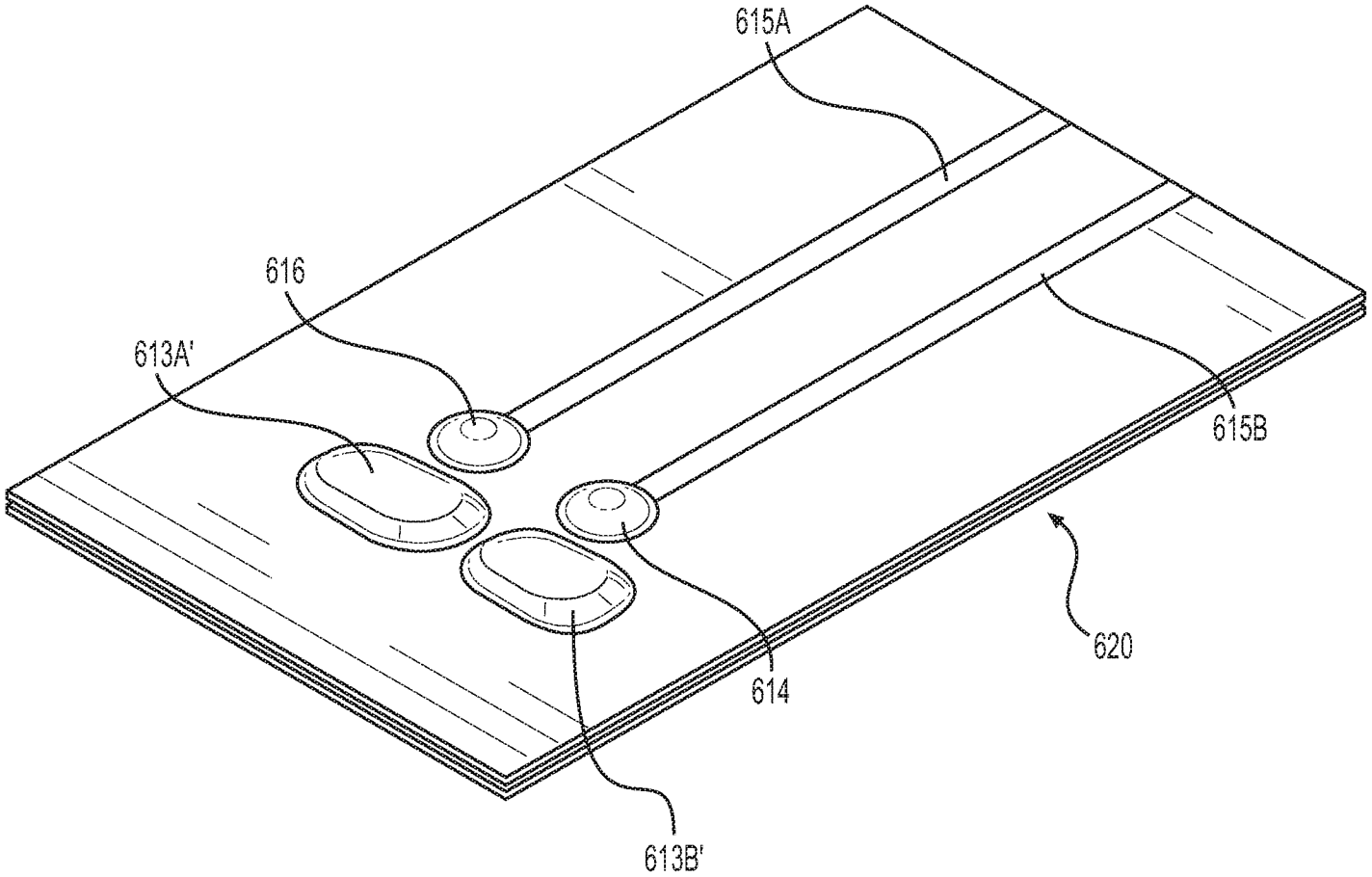
FIG. 18F is a diagram showing an isometric view of a corner at one end of the mouth of a reclosable pouch having a plurality of dimples and two zipper termination channels in accordance with another alternative embodiment.
Figure 18G:
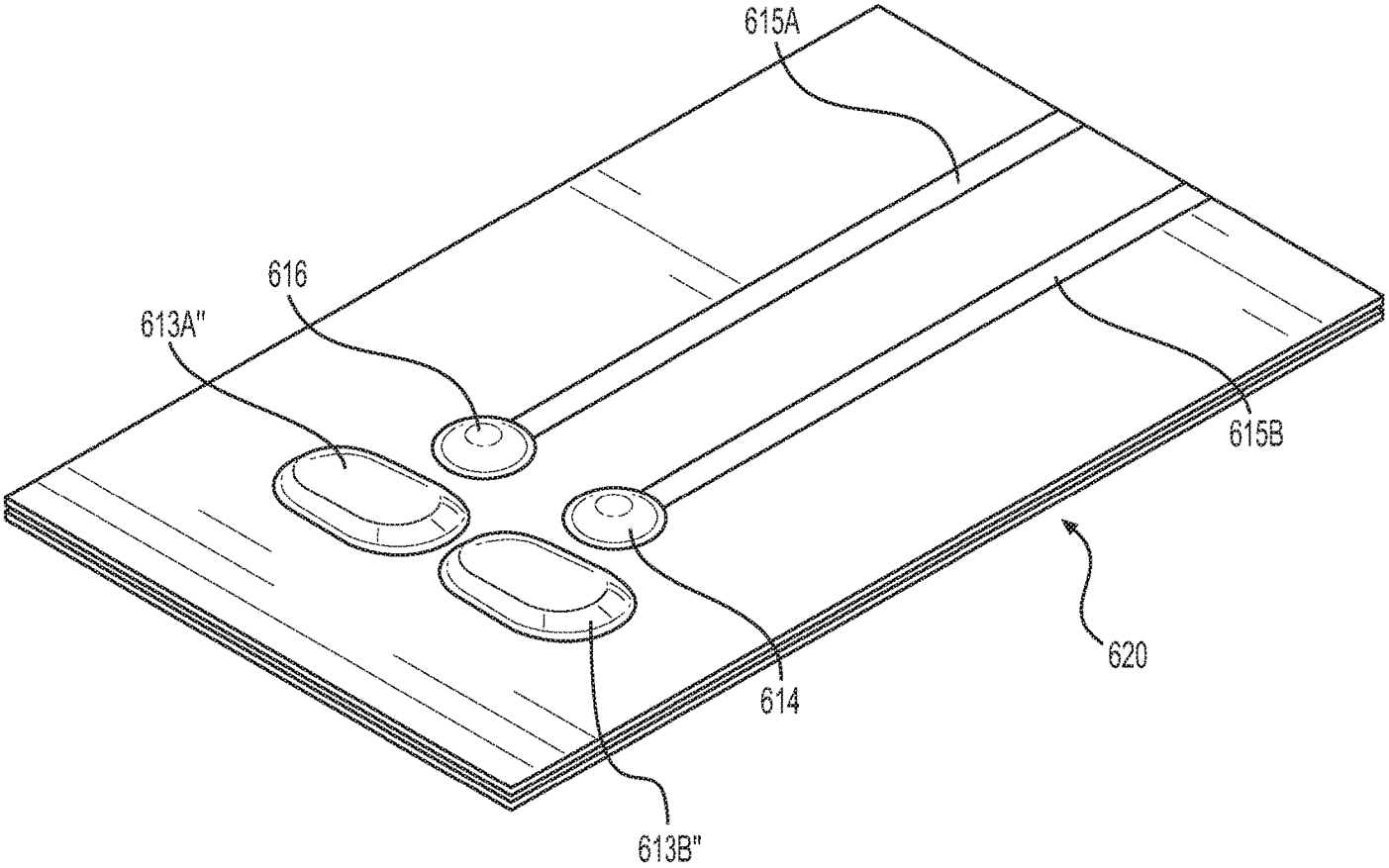
FIG. 18G is a diagram showing an isometric view of a corner at one end of the mouth of a reclosable pouch having a plurality of dimples and two zipper termination channels in accordance with another alternative embodiment.

In addition, although FIGS. 18B-18D illustrate the elongated projection 612, 612', and 612" as being one member of a certain length (L), the elongated projection 612 could alternatively comprise two or more projections with an overall or combined length that overlaps with the dimensions (i.e., L values) and/or ratios (i.e., L:Z) discussed above. For example, as shown in the embodiment of FIG. 18E, a pair of projections 613A, 613B are positioned at the ends of the closures 615A, 615B of the double zipper, with a first projection 613A being positioned in an area above the upper closure 615A, and a second projection 613B being positioned in an area between the upper closure 615A and the lower closure 615B of the double zipper. Alternatively, as shown in the embodiment of FIG. 18F, a pair of projections 613A', 613B' are positioned at the ends of the closures 615A, 615B of the double zipper, with a first projection 613A' being positioned in an area between the upper closure 615A and the lower closure 615B of the double zipper, and a second projection 613B' being positioned in an area below the lower closure 615B of the double zipper. In yet another embodiment, such as the one shown in FIG. 18G, a pair of projections 613A", 613B" are positioned at the ends of the closures 615A, 615B of the double zipper, with a first projection 613A" being positioned in an area (i) between the closures 615A, 615B of the double zipper and (ii) slightly above the upper closure 615A, and a second projection 613B" being positioned in an area (i) between the closures 615A, 615B of the double zipper and (ii) slightly below the lower closure 615B of the double zipper. Although FIGS. 18E-18G illustrate a pair of projections (e.g., 613A and 613B), three or more projections or any other combination of projections could also be included. In addition, as discussed above, the plurality of projections can have an overall or combined length that overlaps with the dimensions (i.e., L values) and/or ratios (i.e., L:Z) discussed above. As similarly discussed above, the placement, length, and/or number of elongated projections 613A, 613B, as well as the extension of the elongated projection(s) 613A, 613B above, below, and/or between the closures of the double zipper relate to points of contact that the elongated projection(s) 613A, 613B has with a slider. These points of contact and the advantages that they provide will be described in more detail below.

Figure 19:
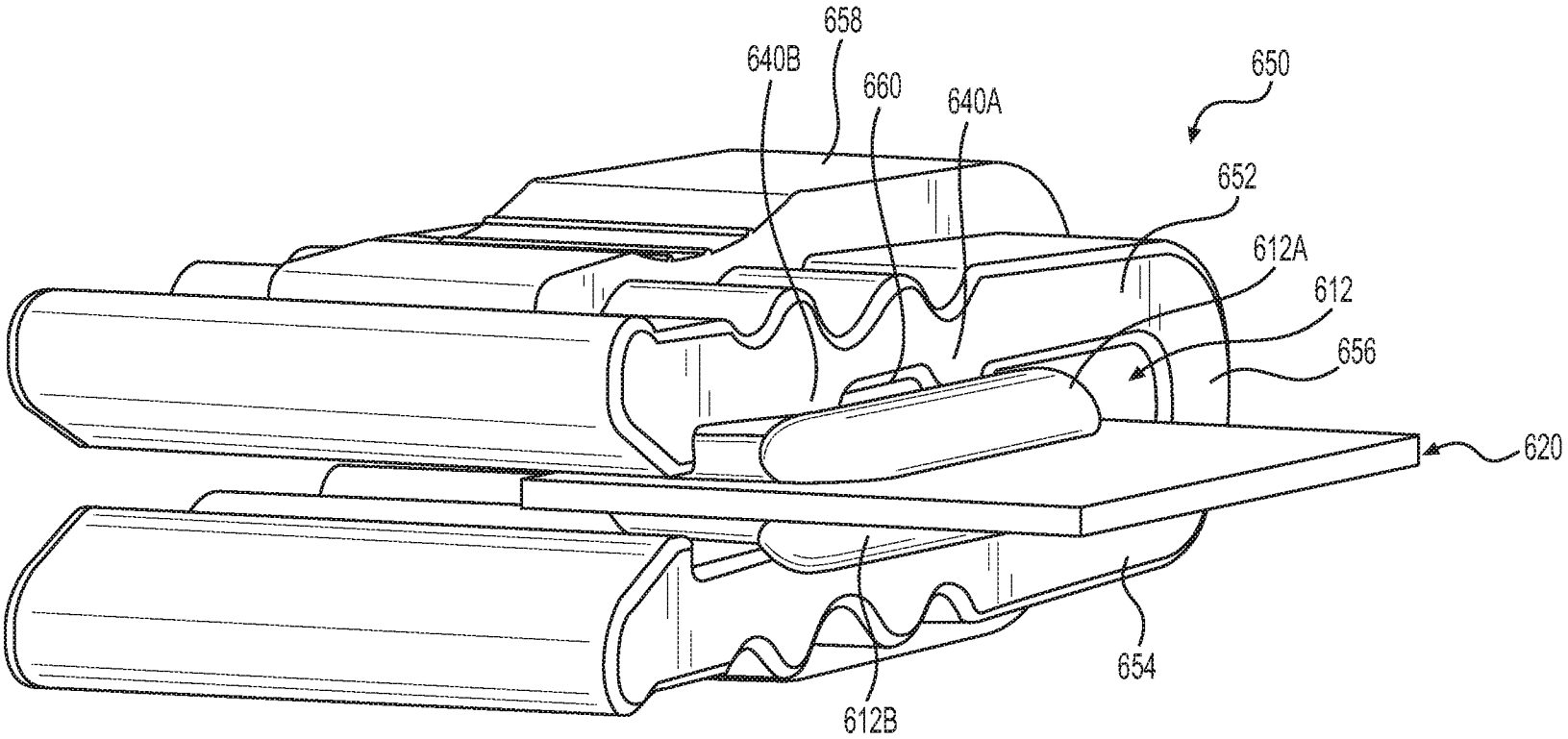
FIG. 19 is a drawing showing an isometric view of a corner at one end of the mouth of a reclosable pouch, which corner has elongated dimple structures for stopping a slider and leakproof zipper terminations in accordance with the type depicted in FIG. 18B.

FIG. 19 illustrates a slider 650 provided on the zipper crush zone of FIG. 18B. As shown in FIG. 19, the pouch corner 620 of the pouch at the end of the closure has an elongated projection 612 that comprises a pair of back-to-back elongated projections 612A, 612B on opposing sides of the pouch. As discussed above, the elongated projections 612A, 612B do not necessarily have to be arranged in a back-to-back configuration. In addition, one or more of the elongated projections 612A, 612B could be positioned on one or both of the sidewalls of the pouch (see, e.g., FIGS. 18E-G). The distance between the peaks of the oppositely extending elongated projections 612A, 612B is sufficiently greater than the width of a gap (S) between contacting portions of the slider 650 (see, e.g., FIG. 21B) that the slider 650 is stopped and cannot pass over the elongated projection 612 (as depicted in FIG. 19). Thus, FIG. 19 shows the slider 650 at the limit of its travel along the closure. The slider 650 can travel no further in the direction of the projection due to the elongated projection 612 in its path and thus is prevented from falling off of the pouch. In one embodiment, a focal point(s) of contact or a center(s) of pressure of the slider 650 is what engages with the elongated projection 612 to prevent the slider 650 from falling off of the pouch. Accordingly, the slider 650 is designed with one or more contacting portions that engage with the elongated projection 612 to stop the slider 650 from further travel.

As seen in FIG. 19, the slider 650 is generally U-shaped and comprises mutually opposing sidewalls 652 and 654, a bridge 656 connecting the sidewalls 652 and 654, and a generally U-shaped stiffening rib 658 projecting outward from the sidewalls 652, 654 and bridge 656. The sidewalls 652 and 654 are separated by a gap (S) of varying width (see, e.g., FIG. 21B). In FIG. 19, the gap is not visible due to the presence of the pouch corner 620 therein. Each sidewall 652, 654 of the slider 650 has a pair of mutually parallel plateaus or ridges 640A, 640B (only the plateaus of sidewall 652 are visible in FIG. 19). The plateaus 640A, 640B define a groove or gap 660 therebetween, as seen in FIG. 19. An identical groove on the other sidewall 654 is not visible in FIG. 19. The plateaus 640A, 640B of sidewall 652 respectively oppose identical plateaus or ridges on the other sidewall 654. The opposing plateaus 640A, 640B form a gap that is less than the combined height of the oppositely projecting back-to-back elongated projection 612. The projection 612 is placed so that it lies in the path of the plateaus 640A, 640B as the slider approaches the projection 612. Thus, the ends of the plateaus 640A, 640B will abut the projection 612 on respective sides of the pouch corner 620 when the consumer pulls the slider toward the pouch side edge. The slider 650 and the projection 612 are sufficiently rigid and the difference between the plateau gap and the projection combined height is sufficiently great that the opposing plateaus 640A, 640B cannot easily pass over the projection 612 after they come into contact. In accordance with the embodiment depicted in FIG. 19, the mutually parallel plateaus or ridges 640A, 640B on each sidewall 652, 654 of the slider 650 provide a two-point contact with the elongated projection 612 on each side of the pouch. This two-point contact, which will be discussed in further detail below, effectively prevents the slider 650 from easily passing over the projection 612 during use.

Figure 20A:
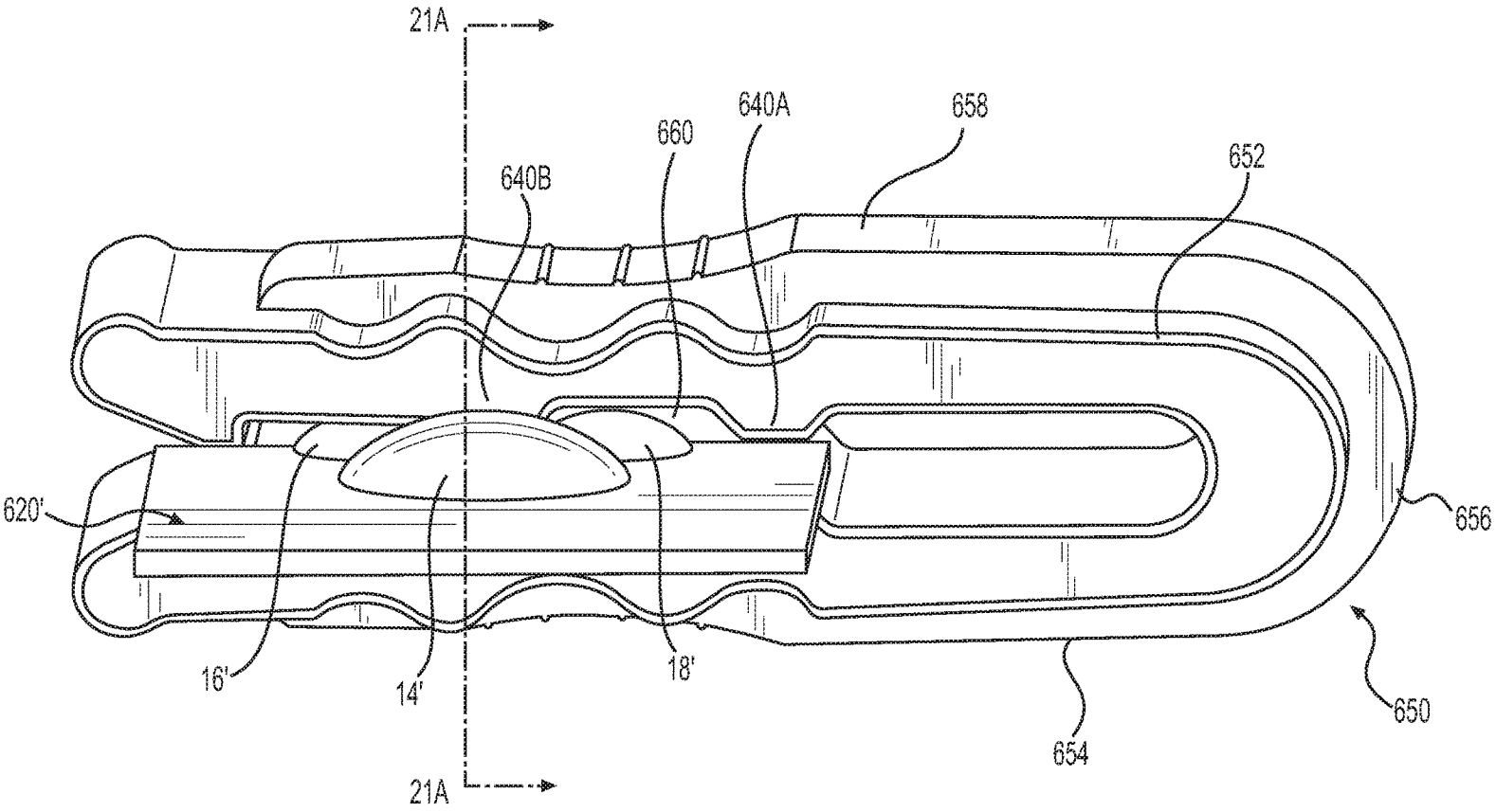
FIG. 20A is a drawing showing an isometric view of a corner at one end of the mouth of a reclosable pouch, which corner has dome-shaped structures for stopping a slider and leakproof zipper terminations in accordance with another embodiment.
Figure 20B:
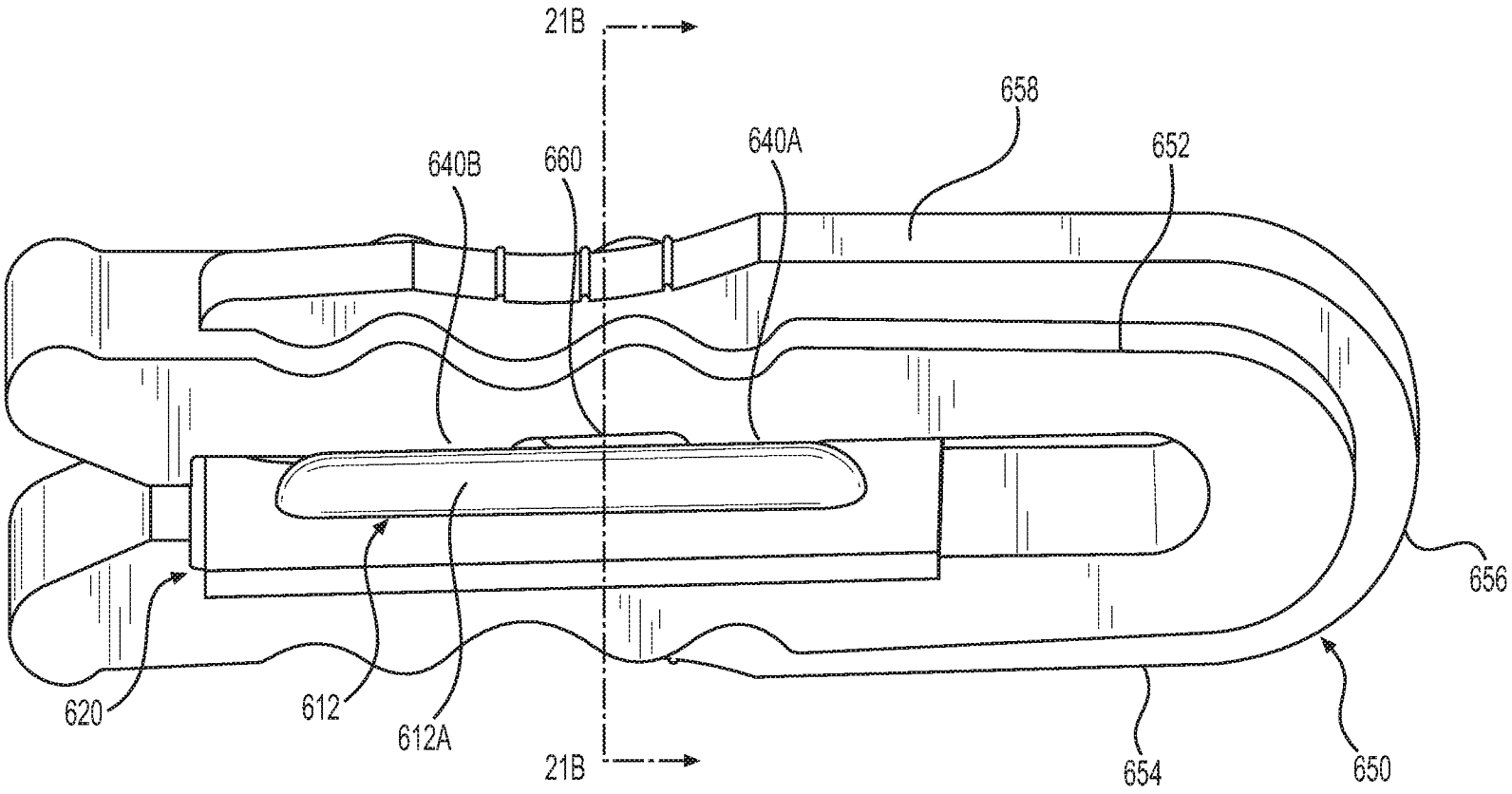
FIG. 20B is a drawing showing an isometric view of a corner at one end of the mouth of a reclosable pouch, which corner has elongated dimple structures for stopping a slider and leakproof zipper terminations in accordance with the embodiment of FIG. 19.

FIG. 20A illustrates an embodiment of a circular domed-shaped projection 14' having a one-point contact with the slider 650 on each side of the pouch, while FIG. 20B illustrates the embodiment of the elongated projection 612 of FIGS. 18A, 18B, and 19 having a two-point contact with the slider 650 on each side of the pouch. In particular, as shown in FIG. 20A, the slider 650 comprises the mutually opposing sidewalls 652 and 654, the bridge 656 connecting the sidewalls 652 and 654, and the generally U-shaped stiffening rib 658 projecting outward from the sidewalls 652, 654 and bridge 656. The slider 650 further includes the pair of mutually parallel plateaus or ridges 640A, 640B (only the plateaus of sidewall 652 are visible in FIG. 20A). The plateaus 640A, 640B define a groove or gap 660 therebetween, as seen in FIG. 20A. An identical groove on the other sidewall 654 is not visible in FIG. 20A. The plateaus 640A, 640B of sidewall 652 respectively oppose identical plateaus or ridges on the other sidewall 654. The opposing plateaus 640B form a gap that is less than a combined height of the oppositely projecting back-to-back domed-shaped projection 14'. The projection 14' is placed so that it lies in the path of the plateau 640B, as the slider approaches the projection 14'. Thus, the end of the plateau 640B will abut the projection 14' on respective sides of the pouch corner 620' when the consumer pulls the slider toward the pouch side edge. In accordance with the embodiment depicted in FIG. 20A, the plateau or ridge 640B of the slider 650 provides a one-point contact with the domed-shaped projection 14' on each side of the pouch. As also shown in FIG. 20A, each of the pouch corners 620' at opposing ends of the closure has respective pairs of half dome-shaped projections 16' and 18' arranged back to back on opposing sides of the pouch (only one pair of these projections is visible in FIG. 20A). The distance between the peaks of the back-to-back projections 16' and 18' is sufficiently greater than the width of a gap between the plateaus 640A, 640B that, when the slider 650 has been stopped by the domed-shaped projection 14', as depicted in FIG. 20A, the back-to-back projections 16' and 18' pose respective obstacles to upward and/or downward movement of at least one of the plateaus 640A, 640B while they are in contact with the domed-shaped projection 14'.

In the embodiment of FIG. 20B, the elongated projection 612 extends to a point above the upper closure of the double zipper (see, e.g., FIG. 18B). Accordingly, as discussed above, the mutually parallel plateaus or ridges 640A, 640B of the slider 650 provide a two-point contact with the elongated projection 612 on each side of the pouch, as opposed to the one-point contact depicted in FIG. 20A. This two-point contact provides a more effective end stop than the one-point contact illustrated in FIG. 20A. In particular, in order for a user to effectively remove the slider from the end stop of FIG. 20B, a much greater slider pull off force is required, as opposed to the end stop and one-point contact of FIG. 20A. Moreover, although not visible in FIG. 20B, each of the pouch corners 620 at opposing ends of the closure has a respective pair of circular-shaped zipper terminations 614 and 616 arranged back to back on opposing sides of the pouch (see, e.g., FIG. 18B). The distance between the peaks of the back-to-back zipper terminations 614 and 616 is sufficiently greater than the width of a gap between the plateaus 640A, 640B that, when the slider 650 has been stopped by the elongated projection 612, as depicted in FIG. 20B, the back-to-back zipper terminations 614 and 616 pose respective obstacles to upward and/or downward movement of at least one of the plateaus 640A, 640B while they are in contact with the elongated projection 612. While the embodiment of FIG. 20B illustrates the two-point contact occurring at a point above the upper closure 615A and at a point between the upper closure 615A and the lower closure 615B of the double zipper, the two-point contact could also occur (i) at a point below the lower closure 615B and at a point between the upper closure 615A and the lower closure 615B of the double zipper, or (ii) at a point above the upper closure 615A and at a point below the lower closure 615B of the double zipper. Alternatively, at least three or more points of contact could occur between the slider 650 and the elongated projection 612, e.g., a three-point contact could occur at (i) a point above the upper closure 615A, (ii) a point below the lower closure 615B, and (iii) a point between the upper closure 615A and the lower closure 615B of the double zipper.

Figure 21A:
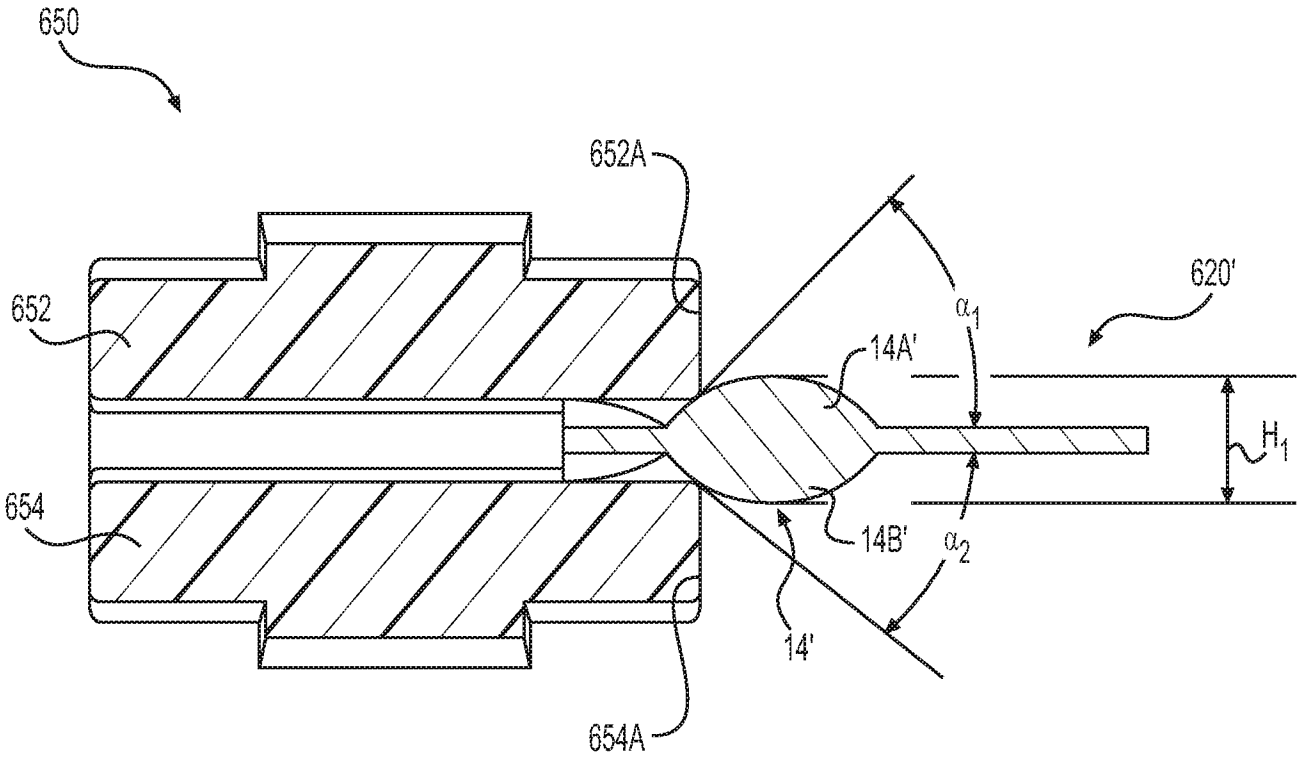
FIG. 21A is a drawing showing a cross-sectional view taken along line 21A-21A of FIG. 20A of the domed-shaped structures and the slider depicted in the embodiment of FIG. 20A.
Figure 21B:
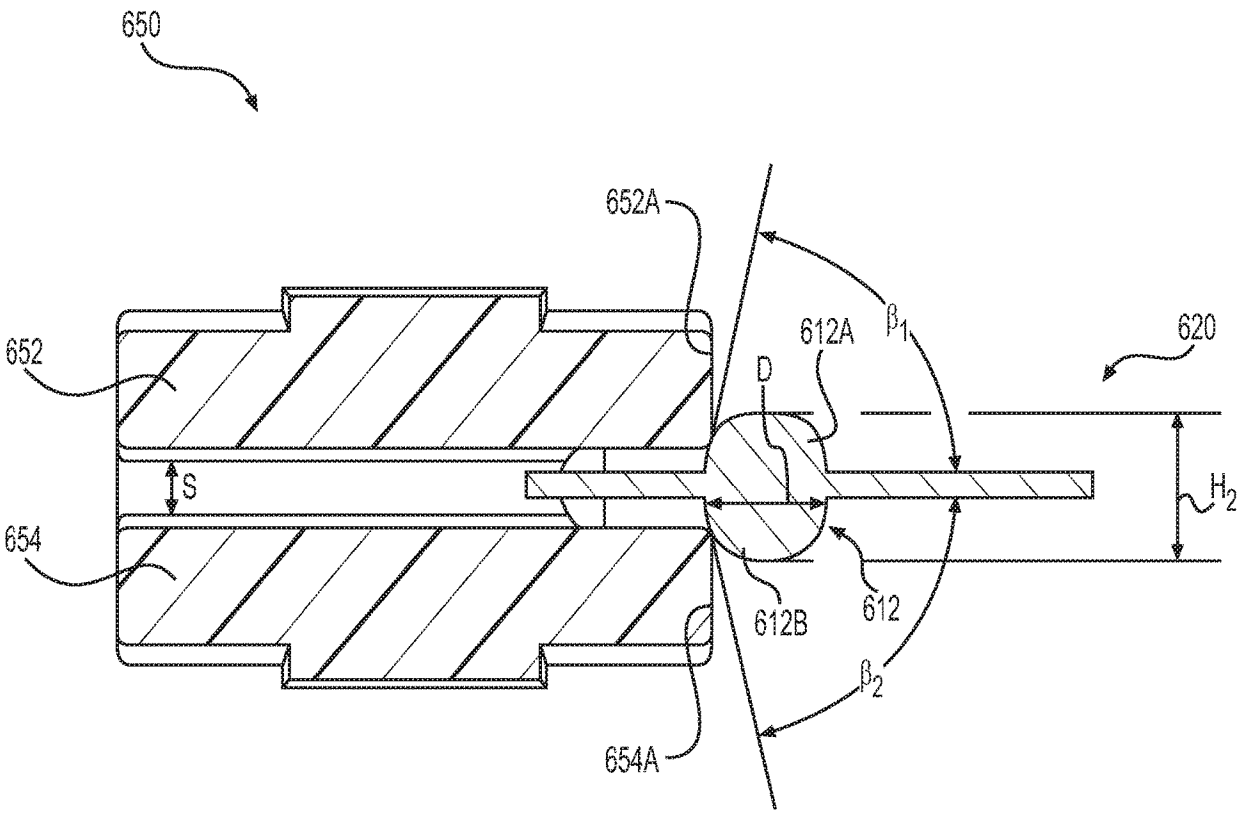
FIG. 21B is a drawing showing a cross-sectional view taken along line 21B-21B of FIG. 20B of the elongated dimple structures and the slider depicted in the embodiment of FIG. 20B.

The two-point contact of the elongated projection 612 of FIGS. 18A, 18B, 19, and 20B, as well as the dimensions of the elongated projection 612, further adds to the effectiveness of the end stop with respect to, for example, the slider pull off force required to remove the slider from the double zipper closure. FIGS. 21A and 21B illustrate the dimensions of the circular dome-shaped projection 14' of FIG. 20A in comparison to the dimensions of the elongated projection 612 of FIGS. 18A, 18B, 19, and 20B. As shown in FIG. 21A, the dome-shaped projection 14' has a height $H_1$ from a top side 14A' to a bottom side 14B' of the back-to-back dome-shaped projection 14'. In one embodiment, this height $H_1$ of the back-to-back dome-shaped projection 14' is between about 3.0 mm (0.118 inches) to about 3.3 mm (0.130 inches), with an average height $H_1$ of about 3.1 mm (0.122 inches). As shown in FIG. 21B, the elongated projection 612 has a height $H_2$ from the top side 612A to the bottom side 612B of the back-to-back elongated projection 612. The height $H_2$ of the elongated projection 612 is preferably greater than the height $H_1$ of the dome-shaped projection 14'. For example, in one embodiment, the height $H_2$ of the elongated projection 612 is greater than about 3.266 mm (0.130 inches). In another embodiment, the height $H_2$ of the elongated projection 612 is between about 3.266 mm (0.130 inches) and about 3.67 mm (0.144 inches), with a preferred height $H_2$ of about 3.468 mm (0.137 inches).

FIGS. 21A and 21B also illustrate the angular dimensions of the dome-shaped projection 14' and the elongated projection 612, respectively. As shown in FIG. 21A, the domed-shaped projection 14', which is shown in cross section, creates two angles, $\alpha_1$ and $\alpha_2$, with respective to the respective sidewalls of the pouch. In particular, the top side 14A' of the dome-shaped projection 14' creates an angle $\alpha_1$ with respect to a top surface of the pouch corner or wall 620', while the bottom side 14B' of the dome-shaped projection 14' creates an angle $\alpha_2$ with respect to a bottom surface of the pouch corner or wall 620'. The angles $\alpha_1$ and $\alpha_2$ of the dome-shaped projection 14' provide the angular dimensions of the portions of the dome-shaped projection 14' that engage with the respective sidewalls 652, 654 of the slider 650. In particular, as shown, for example, in FIG. 21A, portions 652A, 654A of the respective sidewalls 652, 654 of the slider 650 engage with the respective portions of the projection 14'. In one embodiment, the angle $\alpha_1$ is between about 18.5 degrees and about 39.0 degrees, with an average angle around 28.6 degrees, while the angle $\alpha_2$ is between about 20.5 degrees and about 40.6 degrees, with an average angle around 30.6 degrees. As shown in FIG. 21B, the elongated projection 612, which is also shown in cross section, creates two angles, $\beta_1$ and $\beta_2$, with respective to the respective sidewalls of the pouch. In particular, the top side 612A of the elongated projection 612 creates an angle $\beta_1$ with respect to a top surface of the pouch corner or wall 620, while the bottom side 612B of the elongated projection 612 creates an angle $\beta_2$ with respect to a bottom surface of the pouch corner or wall 620. As with the angles $\alpha_1$ and $\alpha_2$ of the dome-shaped projection 14', the angles $\beta_1$ and $\beta_2$ of the elongated projection 612 provide the angular dimensions of the portions of the elongated projection 612 that engage with the respective sidewalls 652, 654 of the slider 650. In particular, as shown, for example, in FIG. 21B, portions 652A, 654A of the respective sidewalls 652, 654 of the slider 650 engage with the respective portions of the projection 612. The angle $\beta_1$ of the elongated projection 612 is preferably greater than the angle $\alpha_1$ of the dome-shaped projection 14', and the angle $\beta_2$ of the elongated projection 612 is preferably greater than the angle $\alpha_2$ of the dome-shaped projection 14'. For example, in one embodiment, the angles $\beta_1$ and $\beta_2$ are each greater than about 50 degrees, preferably, greater than about 51 degrees, and, most preferably, at least one of the angles is greater than about 60 degrees. In one embodiment, the angle $\beta_1$ is between about 53.3 degrees and about 71.4 degrees, with an average angle around 61.0 degrees, while the angle $\beta_2$ is between about 51.4 degrees and about 63.2 degrees, with an average angle around 57.5 degrees. In another embodiment, the angles $\beta_1$ and $\beta_2$ of the elongated projection 612 are each between about 51 degrees and 80 degrees, preferably, between about 51 degrees and 71 degrees, with a most preferred angle of greater than about 60 degrees. In another embodiment, the angles $\beta_1$ and $\beta_2$ of the elongated projection 612 are each about 80 degrees with a variance of plus or minus 5 degrees. Alternatively, the elongated projection 612 could provide angles $\beta_1$ and $\beta_2$ of about 90 degrees, such that a straight wall or edge is created in which to engage with the slider 650. In yet another embodiment, the elongated projection 612 could provide angles $\beta_1$ and $\beta_2$ of greater than 90 degrees. By creating sharper angles $\beta_1$ and $\beta_2$ for the elongated projection 612, the elongated projection 612 has a sharper edge with which to engage with the slider 650, thus, creating an abrupt stop for preventing slider travel. These sharper angles $\beta_1$ and $\beta_2$ further prevent the slider 650 from ramping up and over the elongated projection 612 during use, which is possible with the smaller angles $\alpha_1$ and $\alpha_2$ of the dome-shaped projection 14'. Moreover, by also creating the portions 652A, 654A of the respective sidewalls 652, 654 of the slider 650 that engage with the respective portions of the projection 612 as sharper angles, e.g., between about 80 degrees and about 90 degrees, the slider 650 is even further prevented from ramping up and over the elongated projection 612 during use. In contrast, the smaller angles $\alpha_1$ and $\alpha_2$ of the dome-shaped projection 14', as well as the one-point contact of this projection with the slider, can provide a pivot point in which the slider 650 could ramp up and over the dome-shaped projection 14'. Once the slider 650 ramps up and over the dome-shaped projection 14', the slider 650 falls off of the pouch and must be returned into position on the double zipper by the user. This repositioning of the slider 650 by the user onto the double zipper of the pouch is often a difficult task.

The various dimensions and/or the relationship between the dimensions of the elongated projection 612 also add to the effectiveness of the end stop. For example, another dimension of the elongated projection 612 that adds to the functionality of the end stop is the depth (D) of the projection 612 (see, e.g., FIG. 21B). In particular, the depth (D) of the elongated projection 612 relates to the ability of the projection 612 to effectively act as an end stop for the slider 650, without the slider 650 being able (i) to ramp up and/or over the projection 612, and/or (ii) to shear off the projection 612, due to a lack of depth (D). In one embodiment, the depth (D) of the elongated projection 612 is between about 3.33 mm (0.13 inches) and about 6.66 mm (0.26 inches), with a preferred depth (D) of about 3.39 mm (0.133 inches). Another dimension to consider is the distance or gap (S) between the sidewalls 652, 654 of the slider 650 (see, e.g., FIG. 21B), with respect to, for example, the height ($H_2$) of the elongated projection 612. In one embodiment, the height ($H_2$) of the elongated projection 612 should be at least equal to, and preferably, greater than the distance (S) between the sidewalls 652, 654. For example, in one embodiment, a ratio ($H_2$:S) between the height ($H_2$) of the elongated projection 612 and the gap (S) between the sidewalls 652, 654 of the slider 650 is about a 1:1 ratio. This ratio ($H_2$:S), however, could be about a 2:1 ratio, about a 3:1 ratio, about a 4:1 ratio, about a 5:1 ratio, and/or about a 6:1 ratio. In addition, the ratio ($H_2$:S) can range from about a 1:1 ratio to about a 6:1 ratio, and any value in between. In another embodiment, the height ($H_2$) is preferably about 3.5 to about 6 times the distance of the gap (S) between the sidewalls 652, 654 of the slider 650. In yet another embodiment, the height ($H_2$) and the angles ($\beta_1$ and $\beta_2$) of the elongated projection 612 are related to each other. In particular, in one embodiment, the ratio of at least one of the angles ($\beta_1$ and/or $\beta_2$) to the height ($H_2$) is between about 38 degrees/mm height and about 45 degrees/mm height. In another embodiment, the height ($H_2$) and the angles ($\beta_1$ and $\beta_2$) of the elongated projection 612 are related to each other such that an increase in the height ($H_2$) of the elongated projection 612 results in an increase in at least one of the angles ($\beta_1$ and/or $\beta_2$).

As discussed above, one or more of (a) the two-point contact of the elongated projection 612 and/or (b) the dimensions of the elongated projection 612 adds to the effectiveness of the end stop with respect to, for example, the slider pull off force required to remove the slider from the double zipper closure. To measure the slider pull off force (lbf), the following procedure was conducted. To begin, a bag with a double zipper, an end stop or projection(s), and a slider is selected for analysis. Using a ruler, a seven (7) inch portion of the bag is measured and marked with a pen, pencil, or other writing instrument. This portion is measured and marked from a side edge of the bag to seven (7) inches into the interior of the bag, with the measurement being parallel to the double zipper and just below the lower closure of the double zipper (i.e., about 0.5 inch to about 1.0 inch below the lower closure of the double zipper). A rectangular portion of the bag is then cut. This cut rectangular portion, which is the portion of the bag to be analyzed, comprises the measured and marked seven (7) inch portion of the bag, the top edge of the bag, the double zipper in between the top edge and the measured and marked seven (7) inch portion, and an edge that is cut from the top edge of the bag to the end of the measured and marked seven (7) inch portion of the bag. The cut rectangular portion should also include the end stop or projection(s) and the slider positioned on the double zipper of the cut portion, with the slider being positioned adjacent to the end stop or projection(s) (i.e., the position as shown in FIGS. 19, 20A, and 20B). Once the rectangular portion of the bag has been cut, the rectangular portion is labeled to indicate the test to be performed (e.g., the number of the test, the bag type, the date, etc.). Preferably, the rectangular portion is labeled with a number on the exterior surface of the double zipper that is next to the side of the slider that is not positioned adjacent to the end stop or projection(s). The rectangular bag portion is now ready to be analyzed for the slider pull off force.

Figure 22:
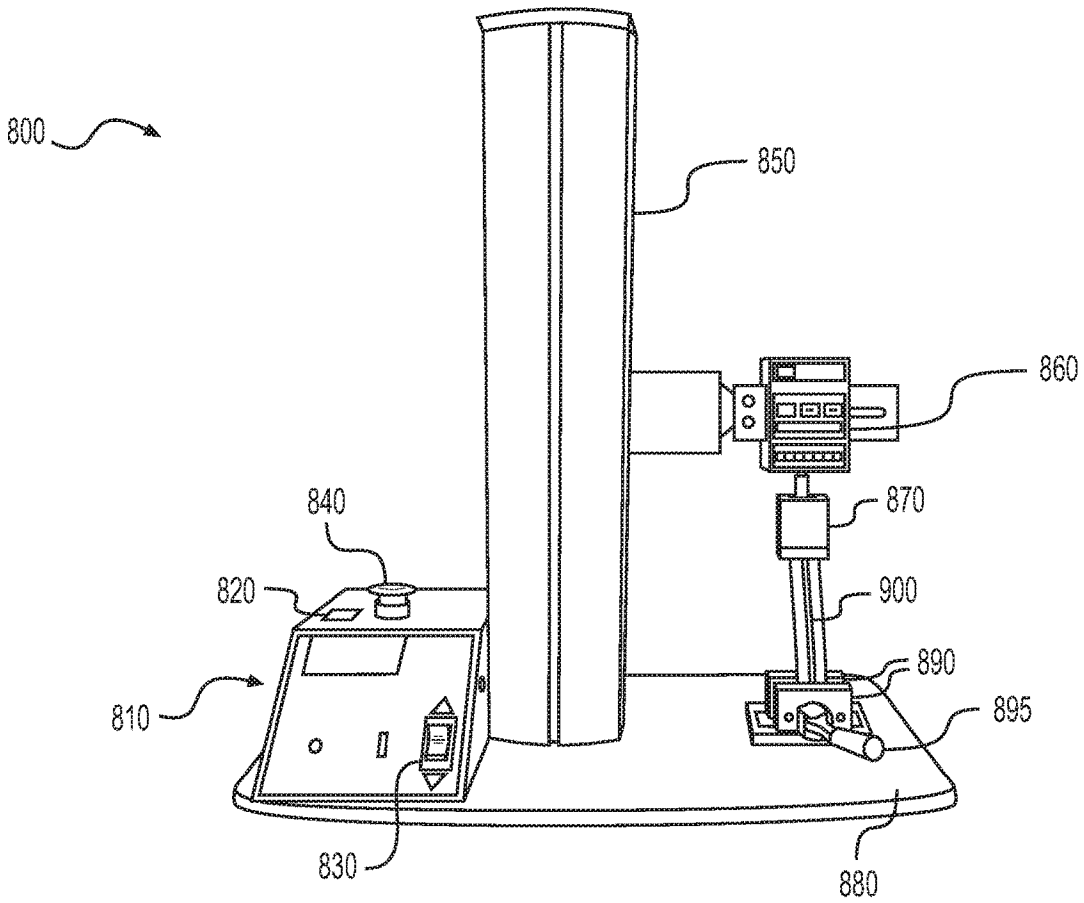
FIG. 22 is a diagram of a testing machine configured to measure the slider pull off force required to remove a slider from a reclosable pouch.

The slider pull off force (lbf) is measured using a Chatillon® LTCM-6 Testing Machine, which is available from S.A. Meier Company of Milwaukee, Inc., Wales, Wis., and comprises a universal tension/compression tester. The tester, which, for example, is shown in FIG. 22, comprises a bench mountable, single column, self-contained, motor driven tension and compression tester. As shown in FIG. 22, the tester 800 includes a controller 810 with a power button 820, an up/down button 830, and an emergency button 840. The tester 800 further includes a column 850 that is connected to a base 880, a digital force meter 860, and a slider lock head 870. The digital force meter 860, which has a measurement range of up to 50 lbs, is calibrated to ensure accurate force readings. The base 880 includes a zipper fixture 890 that comprises a clamp and is connected with a handle lock and release 895. In the embodiment of FIG. 22, a cut rectangular portion 900 of the bag is placed between the slider lock head 870 and the zipper fixture 890. To begin testing, the tester 800 is turned on using the power button 820. The digital force meter 860 is also turned on and checked to confirm that the force value registers as 0.00 lbs, before the start of the test. The cut rectangular portion 900 of the bag is thereafter placed between the zipper fixture 890 and the slider lock head 870. In particular, the edge of the rectangular portion 900 that includes the end stop or projection(s) and the slider is positioned within the slider lock head 870. The height of the slider lock head 870 and the digital force meter 860 is then adjusted, using the up/down button 830 on the controller 810, until the cut edge of the rectangular portion 900 of the bag that opposes the edge with the end stop/projection(s) and the slider, is positioned within the zipper fixture 890 (see, e.g., FIG. 22). The handle lock and release 895 should be released outwards to ensure that the zipper fixture 890, which comprises a clamp, is open and able to accept the cut edge of the rectangular portion 900 of the bag. The height of the slider lock head 870 and the digital force meter 860 should be adjusted until the rectangular portion 900 of the bag fits within the slider lock head 870 and the zipper fixture 890, with no pressure being applied to the slider or the end stop/projection(s). The handle of the handle lock and release 895 is then closed inwards to close the clamp of the zipper fixture 890, such that the cut edge of the rectangular portion 900 of the bag is tightly held within the zipper fixture 890. At this point, the rectangular portion 900 of the bag is held between the slider lock head 870 and the zipper fixture 890, with no pressure being applied to the slider or the end stop/projection(s).

To begin the slider pull off force measurement, the up button of the up/down button 830 is pushed down and held by a user. By holding down the up button of the up/down button 830, the digital force meter 860 and the slider lock head 870 will begin to rise vertically and to pull on the slider positioned on the double zipper of the rectangular portion 900 of the bag. As the digital force meter 860 and the slider lock head 870 pull on the slider, the digital force meter 860 will begin to register increasing force values (lbs). At some point, the slider will be pulled (i) off of the double zipper of the rectangular portion 900 of the bag, and (ii) over the end stop/projection(s) of the rectangular portion 900 of the bag. When the slider has been pulled off of the double zipper and over the end stop/projection(s) of the rectangular portion 900 of the bag, the digital force meter 860 will register 0.00 lbs, and the up button of the up/down button 830 should then be released. By pressing a "peak" button on the digital force meter 860, the maximum force (lbf) applied to the slider during the testing (i.e., the maximum slider pull off force) can be determined. This "peak" force value (lbf) or maximum slider pull off force (lbf) is then recorded. The test is preferably conducted on between five and fifteen samples of the same type of bag, with the maximum slider pull off force (lbf) being measured for a slider positioned adjacent to each of the end stop/projection(s) on each side of the bag. An overall average of the maximum slider pull off force (lbf) is then calculated for each side of the bag. In one embodiment, a slider pull off force of at least about 9.0 lbf, and up to about 12.0 lbf, was measured to remove the slider 650 from a bag having the elongated projection 612 of the invention, while a maximum slider pull off force of between about 2.0 lbf and about 7.4 lbf was measured to remove the slider 650 from a bag having the dome-shaped projection 14' of, for example, FIG. 20A.

To further illustrate the effectiveness of the elongated projection 612 with respect to, for example, the slider pull off force required to remove the slider from the double zipper closure, the elongated projection 612 of the invention was compared to prior art end stop projections. In particular, eight prior art products (see, e.g., Prior Art (A) through (H) of Table 1 below) were compared to the elongated projection 612 of the invention with respect to (i) the number of points of contact and the dimensions of the prior art end stop projections in view of the two-point contact and the dimensions of the elongated projection 612 of the invention, and (ii) the maximum slider pull off force achieved by the prior art end stop projections in view of the maximum slider pull off force achieved by the elongated projection 612. The prior art end stop projections all embodied end stops with only a single point of contact with the slider, as discussed above for the dome-shaped projection 14'. The prior art end stop projections, however, had either a round-shaped projection (see, e.g., the dome-shaped projection 14' of FIG. 20A), an oval-shaped projection (see, e.g., the oval-shaped projection 112 of FIG. 14), or a u-shaped projection that connected to the ends of the double zipper. The dimensions, i.e., heights and angles, of the end stop projections were measured in the same manner as discussed above for the heights ($H_1$ and $H_2$) of the dome-shaped projection 14' and the elongated projection 612, and the angles ($\alpha_1$, $\alpha_2$, $\beta_1$, and $\beta_2$) of the dome-shaped projection 14' and the elongated projection 612. In addition, the maximum slider pull off force (lbf) was measured in the same manner as discussed above. For each of the heights, angles, and maximum slider pull off force values, five to fifteen samples of each type of bag and zipper closure were measured on both the left and right side of the respective closure. An average of each of these values was then calculated for each bag. The various measurements for each of the prior art end stop projections in view of the various measurements for the elongated projection 612 of the invention are shown in Table 1 below, with the values comprising an average value for the samples measured:

TABLE 1

| Sample Product | Number of Points of Contact with a Slider | Projection Shape | Height of Projection (mm) ($H_1$ or $H_2$) | Angular Measurements of Projection (degrees) ($\alpha_1$, $\alpha_2$, $\beta_1$, or $\beta_2$) | Maximum Slider Pull Off Force (lbf) |
|---|---|---|---|---|---|
| Prior Art (A) | Single | Domed-shaped projection | 3.095 | 28.56; 30.55 | 7.36 |
| Prior Art (B) | Single | Domed-shaped projection | 2.868 | 39.02; 35.45 | 8.51 |
| Prior Art (C) | Single | Domed-shaped projection | 3.243 | 34.09; 34.10 | 2.02 |
| Prior Art (D) | Single | Oval-shaped projection | 2.296 | 45.66; 47.28 | 1.07 |
| Prior Art (E) | Single | Oval-shaped projection | 2.300 | 29.60; 30.17 | 5.52 |
| Prior Art (F) | Single | Oval-shaped projection | 2.554 | 51.61; 53.01 | 0.96 |
| Prior Art (G) | Single | Oval-shaped projection | 2.086 | 34.14; 36.13 | 2.88 |
| Prior Art (H) | Single | U-shaped projection | 2.407 | 10.09; 45.03 | 3.20 |
| Elongated Projection (612) of the Invention | Two-Points of Contact | Elongated Projection (612) of the Invention | 3.515 | 61.01; 57.48 | 11.83 |

As seen in Table 1 above, the elongated projection 612 of the invention achieves a higher maximum slider pull off force than that of any of the prior art end stop projections. Without intending to be limited by theory, it is believed that one or more of (a) the two-point contact of the elongated projection 612 of the invention and/or (b) the various dimensions of the elongated projection 612 add to the effectiveness of the end stop with respect to, for example, the maximum slider pull off force required to remove the slider from the double zipper closure. In particular, as shown in Table 1 above, the elongated projection 612 of the invention has (i) a greater height (mm), as compared to that of the prior art end stop projections, (ii) sharper angles (degrees), as compared to those of the prior art end stop projections, and (iii) a two-point contact with the slider, as opposed to the single-point contact of the prior art end stop projections with the slider. Each of these features and/or a combination of these features of the elongated projection 612 of the invention is considered to add to the effectiveness of the end stop with respect to, for example, the maximum slider pull off force.

Illustrative thermoplastic materials that could be used to form the various pouches discussed above include, for example, polypropylene (PP), polyethylene (PE), metallocene-polyethylene (mPE), low density polyethylene (LDPE), linear low density polyethylene (LLDPE), ultra low density polyethylene (ULDPE), biaxially-oriented polyethylene terephthalate (BPET), high density polyethylene (HDPE), polyethylene terephthalate (PET), among other polyolefin plastomers and combinations and blends thereof. Still other materials that may be used include styrenic block copolymers, polyolefin blends, elastomeric alloys, thermoplastic polyurethanes, thermoplastic copolyesters, thermoplastic polyamides, polymers and copolymers of polyvinyl chloride (PVC), polyvinylidene chloride (PVDC), saran polymers, ethylene/vinyl acetate copolymers, cellulose acetates, polyethylene terephthalate (PET), ionomer, polystyrene, polycarbonates, styrene acryloacrylonitrile, aromatic polyesters, linear polyesters, and thermoplastic polyvinyl alcohols. The first and second zipper strips of the various embodiments discussed above may each be formed of thermoplastic, such as low density polyethylene (LDPE), high density polyethylene (HDPE), linear low density polyethylene (LLDPE), ethylene vinyl alcohol, and combinations thereof. The sliders of the various embodiments discussed above may be formed of any suitable material, such as, for example, polybutylene terephthalate, polypropylene, nylon, polystyrene, acetal, polyketone, high density polyethylene, polycarbonate, acrylonitrile butadiene styrene, acetal copolymer, or the like, and any combinations thereof. Those skilled in the art will recognize that a wide variety of other materials may also be used to form the pouches, the zipper strips, and/or the sliders.

While the invention has been described with reference to various embodiments, it will be understood by those skilled in the art that various changes may be made and equivalents may be substituted from elements thereof without departing from the scope of the invention. In addition, many modifications may be made to adapt a particular situation to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

INDUSTRIAL APPLICABILITY

The invention described herein can be used in the commercial production of reclosable pouches and/or storage bags with single and/or double zipper closure profiles. Such pouches have a wide variety of uses, such as being utilized to store articles of clothing, food, chemicals, or other substances and/or items.

We claim:

1. A reclosable pouch comprising:

(A) a receptacle having a top edge, a storage chamber and a mouth in communication with the storage chamber, the receptacle comprising a first sidewall and a second sidewall connected to the first sidewall so as to form the storage chamber;

(B) a hermetically sealable closure attached to the mouth, the closure comprising a first zipper strip and a second zipper strip, the first and second zipper strips being fused together in first and second zones situated at respective ends of the closure, with a space between the first and second zones, and (a) a portion of the first zipper strip in the space between the first and second zones comprising first and second closure elements projecting from the first zipper strip, and (b) a portion of the second zipper strip in the space between the first and second zones comprising third and fourth closure elements projecting from the second zipper strip, the first through fourth closure elements spanning the space between the first and second zones, and the first and third closure elements forming a first zipper that terminates in a first zipper termination at each of the first and second zones, the second and fourth closure elements forming a second zipper that terminates in a second zipper termination at each of the first and second zones, with a space between the first and second zippers;

(C) a slider mounted to the closure and configured to travel along the first and second zippers, the slider comprising a first sidewall and a second sidewall, each sidewall including a pair of protruding portions, with at least one of the protruding portions of the pair of protruding portions (i) being disposed in the space between the first and second zippers and (ii) protruding into the space between the first and second zippers, the slider further including a gap formed between the pair of protruding portions of the first sidewall and the pair of protruding portions of the second sidewall;

(D) a first pair of elongated projections arranged back to back on the first and second sidewalls of the receptacle, the first pair of elongated projections being positioned at the first end of the closure in the first zone, each projection of the first pair of elongated projections having (i) a height, (ii) a length (L) that is equal to or greater than a distance (Z) between centerlines of the first and second zippers, and (iii) at least one angle with respect to the respective sidewall of the receptacle of at least about 51 degrees, and each projection of the first pair of elongated projections being spaced from the top edge of the receptacle; and (E) a second pair of elongated projections arranged back to back on the first and second sidewalls of the receptacle, the second pair of elongated projections being positioned at the second end of the closure in the second zone, each projection of the second pair of elongated projections having (i) a height, (ii) a length (L) that is equal to or greater than the distance (Z) between centerlines of the first and second zippers, and (iii) at least one angle with respect to the respective sidewall of the receptacle of at least about 51 degrees, and each projection of the second pair of elongated projections being spaced from the top edge of the receptacle, wherein (a) each pair of the first and second pairs of elongated projections (i) prevents travel of the slider at the respective end of the closure upon at least a two-point contact of the respective pairs of protruding portions of the first and second sidewalls of the slider with the respective pair of elongated projections, and (ii) has a combined height of greater than the width of the gap formed between the pair of protruding portions of the first and second sidewalls of the slider, thereby preventing movement of the slider at the respective ends of the closure upon contact of the respective pairs of protruding portions of the first and second sidewalls of the slider with the respective pair of elongated projections, and (b) the first and second zipper terminations at each of the first and second zones prevent upward and downward movement of the slider at the respective ends of the closure upon contact of at least one of the protruding portions of the respective pair of protruding portions of the first and second sidewalls of the slider with the respective first and second zipper terminations.

2. The reclosable pouch according to claim 1, wherein each pair of the first and second pairs of elongated projections is separate and distinct from each of the first and second zipper terminations of the first and second zippers.

3. The reclosable pouch according to claim 1, wherein each projection of each pair of the first and second pairs of elongated projections has a length (L) of between about 13.2 mm and about 18.3 mm.

4. The reclosable pouch according to claim 1, wherein a ratio between the length (L) and the distance (Z) is at least about 1:1.

5. The reclosable pouch according to claim 1, wherein the length (L) is about 2 to about 4 times the distance (Z).

6. The reclosable pouch according to claim 1, wherein each pair of the first and second pairs of elongated projections has a combined height of between about 3.3 mm and about 3.7 mm.

7. The reclosable pouch according to claim 1, wherein at least one angle with respect to the respective sidewall of the receptacle is at least about 60 degrees.

8. The reclosable pouch according to claim 1, wherein each pair of the first and second pairs of elongated projections creates (i) a first angle $\beta_1$ with respect to the first sidewall and (ii) a second angle $\beta_2$ with respect to the second sidewall, with each of the first angle $\beta_1$ and the second angle $\beta_2$ being between about 51 degrees and about 80 degrees.

9. The reclosable pouch according to claim 1, wherein each pair of the first and second pairs of elongated projections has a ratio of (a) the at least one angle to (b) a height of the projection of between about 38 degrees/mm height and about 45 degrees/mm height.

10. The reclosable pouch according to claim 1, wherein an average force of greater than about 9.0 lbf is required to remove the slider from the pouch over at least one of the elongated projections.

11. The reclosable pouch according to claim 1, wherein the at least a two-point contact between the slider and each of the first and second pairs of elongated projections occurs at one of (i) a point above the first zipper and a point between the first and second zippers, (ii) a point below the second zipper and a point between the first and second zippers, and (iii) a point above the first zipper and a point below the second zipper.

12. A reclosable pouch comprising:

(A) a receptacle having a top edge, a storage chamber, and a mouth in communication with the storage chamber, the receptacle comprising a first sidewall and a second sidewall connected to the first sidewall so as to form the storage chamber;

(B) a hermetically sealable closure attached to the mouth, the closure comprising a first zipper strip and a second zipper strip, the first and second zipper strips being fused together in first and second zones situated at respective ends of the closure, with a space between the first and second zones, and (a) a portion of the first zipper strip in the space between the first and second zones comprising first and second closure elements projecting from the first zipper strip, and (b) a portion of the second zipper strip in the space between the first and second zones comprising third and fourth closure elements projecting from the second zipper strip, the first through fourth closure elements spanning the space between the first and second zones, the first and third closure elements forming a first zipper that terminates in a first zipper termination at each of the first and second zones, the second and fourth closure elements forming a second zipper that terminates in a second zipper termination at each of the first and second zones, with a space between the first and second zippers;

(C) a slider mounted to the closure and configured to travel along the first and second zippers, the slider comprising a first sidewall and a second sidewall, each sidewall including a pair of protruding portions, with at least one of the protruding portions of the pair of protruding portions (i) being disposed in the space between the first and second zippers and (ii) protruding into the space between the first and second zippers, the slider further including a gap formed between the pair of protruding portions of the first sidewall and the pair of protruding portions of the second sidewall;

(D) a first pair of elongated projections arranged back to back on the first and second sidewalls of the receptacle, the first pair of elongated projections being positioned at the first end of the closure in the first zone, each projection of the first pair of elongated projections extending from one of (i) a point above the first zipper to a point between the first and second zippers, (ii) a point below the second zipper to a point between the first and second zippers, and (iii) a point above the first zipper to a point below the second zipper, and each projection of the first pair of elongated projections being spaced from the top edge of the receptacle; and (E) a second pair of elongated projections arranged back to back on the first and second sidewalls of the receptacle, the second pair of elongated projections being positioned at the second end of the closure in the second zone, each projection of the second pair of elongated projections extending from one of (i) a point above the first zipper to a point between the first and second zippers, (ii) a point below the second zipper to a point between the first and second zippers, and (iii) a point above the first zipper to a point below the second zipper, and each projection of the second pair of elongated projections being spaced from the top edge of the receptacle, wherein (a) each pair of the first and second pairs of elongated projections (i) prevents travel of the slider at the respective end of the closure upon at least a two-point contact of the respective pairs of protruding portions of the first and second sidewalls of the slider with the respective pair of elongated projections, and (ii) has a combined height of greater than the width of the gap formed between the pair of protruding portions of the first and second sidewalls of the slider, thereby preventing movement of the slider at the respective ends of the closure upon contact of the respective pairs of protruding portions of the first and second sidewalls of the slider with the respective pair of elongated projections, and (b) the first and second zipper terminations at each of the first and second zones prevent upward and downward movement of the slider at the respective ends of the closure upon contact of at least one of the protruding portions of the respective pair of protruding portions of the first and second sidewalls of the slider with the respective first and second zipper terminations.

13. The reclosable pouch according to claim 12, wherein each pair of the first and second pairs of elongated projections is separate and distinct from each of the first and second zipper terminations of the first and second zippers.

14. The reclosable pouch according to claim 12, wherein each projection of each pair of the first and second pairs of elongated projections extends to a point that is between the first zipper and the top edge of the receptacle.

15. The reclosable pouch according to claim 12, wherein each projection of the first and second pairs of elongated projections has a length (L) that is equal to or greater than a distance (Z) between centerlines of the first and second zippers.

16. The reclosable pouch according to claim 15, wherein a ratio between the length (L) and the distance (Z) is at least about 1:1.

17. The reclosable pouch according to claim 15, wherein the length (L) is about 2 to about 4 times the distance (Z).

18. The reclosable pouch according to claim 12, wherein each projection of the first and second pairs of elongated projections has at least one angle with respect to the respective sidewall of the receptacle of at least about 51 degrees.

19. The reclosable pouch according to claim 12, wherein an average force of greater than about 9.0 lbf is required to remove the slider from the pouch over at least one of the elongated projections.

20. The reclosable pouch according to claim 12, wherein the at least a two-point contact between the slider and each of the first and second pairs of elongated projections occurs at one of (i) a point above the first zipper and a point between the first and second zippers, (ii) a point below the second zipper and a point between the first and second zippers, and (iii) a point above the first zipper and a point below the second zipper.

21. A reclosable pouch comprising:

(A) a receptacle having a top edge, a storage chamber and a mouth in communication with the storage chamber, the receptacle comprising a first sidewall and a second sidewall connected to the first sidewall so as to form the storage chamber;

(B) a hermetically sealable closure attached to the mouth, the closure comprising a first zipper strip and a second zipper strip, the first and second zipper strips being fused together in first and second zones situated at respective ends of the closure, with a space between the first and second zones, and (a) a portion of the first zipper strip in the space between the first and second zones comprising first and second closure elements projecting from the first zipper strip, and (b) a portion of the second zipper strip in the space between the first and second zones comprising third and fourth closure elements projecting from the second zipper strip, the first through fourth closure elements spanning the space between the first and second zones, the first and third closure elements forming a first zipper that terminates in a first zipper termination at each of the first and second zones, the second and fourth closure elements forming a second zipper that terminates in a second zipper termination at each of the first and second zones, with a space between the first and second zippers;

(C) a slider mounted to the closure and configured to travel along the first and second zippers, the slider comprising a first sidewall and a second sidewall, each sidewall including a pair of protruding portions, with at least one of the protruding portions of the pair of protruding portions (i) being disposed in the space between the first and second zippers and (ii) protruding into the space between the first and second zippers, the slider further including a gap formed between the pair of protruding portions of the first sidewall and the pair of protruding portions of the second sidewall;

(D) a first pair of elongated projections arranged back to back on the first and second sidewalls of the receptacle, the first pair of elongated projections being positioned at the first end of the closure in the first zone, and each projection of the first pair of elongated projections being spaced from the top edge of the receptacle; and (E) a second pair of elongated projections arranged back to back on the first and second sidewalls of the receptacle, the second pair of elongated projections being positioned at the second end of the closure in the second zone, and each projection of the second pair of elongated projections being spaced from the top edge of the receptacle, wherein (a) each pair of the first and second pairs of elongated projections (i) prevents travel of the slider at the respective end of the closure upon at least a two-point contact of the respective pairs of protruding portions of the first and second sidewalls of the slider with the respective pair of elongated projections, and (ii) has a combined height of greater than the width of the gap formed between the pair of protruding portions of the first and second sidewalls of the slider, thereby preventing movement of the slider at the respective ends of the closure upon contact of the respective pairs of protruding portions of the first and second sidewalls of the slider with the respective pair of elongated projections, and (b) the first and second zipper terminations at each of the first and second zones prevent upward and downward movement of the slider at the respective ends of the closure upon contact of at least one of the protruding portions of the respective pair of protruding portions of the first and second sidewalls of the slider with the respective first and second zipper terminations, and wherein an average force of greater than about 9.0 lbf is required to remove the slider from the pouch over at least one of the elongated projections.

22. The reclosable pouch according to claim 21, wherein each pair of the first and second pairs of elongated projections is separate and distinct from each of the first and second zipper terminations of the first and second zippers.

23. The reclosable pouch according to claim 21, wherein an average force of up to about 12.0 lbf is required to remove the slider from the pouch over at least one of the elongated projections.

24. The reclosable pouch according to claim 21, wherein the at least a two-point contact between the slider and each of the first and second pairs of elongated projections occurs at one of (i) a point above the first zipper and a point between the first and second zippers, (ii) a point below the second zipper and a point between the first and second zippers, and (iii) a point above the first zipper and a point below the second zipper.

25. The reclosable pouch according to claim 21, wherein each projection of the first and second pairs of elongated projections has at least one angle with respect to the respective sidewall of the receptacle of at least about 51 degrees.

26. The reclosable pouch according to claim 21, wherein each projection of the first and second pairs of elongated projections has a length (L) that is equal to or greater than a distance (Z) between centerlines of the first and second zippers.

27. The reclosable pouch according to claim 26, wherein a ratio between the length (L) and the distance (Z) is at least about 1:1.

28. The reclosable pouch according to claim 26, wherein the length (L) is about 2 to about 4 times the distance (Z).

* * * * *